US006652058B2

(12) United States Patent
Kanematsu et al.

(10) Patent No.: US 6,652,058 B2
(45) Date of Patent: Nov. 25, 2003

(54) RECORDING APPARATUS AND RECORDING CONTROL METHOD, AND INK JET RECORDING METHOD AND APPARATUS

(75) Inventors: Daigoro Kanematsu, Kanagawa (JP); Akiyoshi Shimoda, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/078,438

(22) Filed: Feb. 21, 2002

(65) Prior Publication Data

US 2002/0113832 A1 Aug. 22, 2002

(30) Foreign Application Priority Data

Feb. 22, 2001 (JP) ..... 2001-047032
Feb. 22, 2001 (JP) ..... 2001-047036

(51) Int. Cl.[7] ..... B41J 29/38
(52) U.S. Cl. ..... 347/14; 347/9; 347/211
(58) Field of Search ..... 347/9, 14, 211, 347/5

(56) References Cited

U.S. PATENT DOCUMENTS

| | | | | |
|---|---|---|---|---|
| 4,313,124 A | | 1/1982 | Hara | 346/140 |
| 4,345,262 A | | 8/1982 | Shirato et al. | 346/140 |
| 4,459,600 A | | 7/1984 | Sato et al. | 346/140 |
| 4,463,359 A | | 7/1984 | Ayata et al. | 346/1.1 |
| 4,558,333 A | | 12/1985 | Sugitani et al. | 346/140 |
| 4,723,129 A | | 2/1988 | Endo et al. | 346/1.1 |
| 4,740,796 A | | 4/1988 | Endo et al. | 346/1.1 |
| 5,017,948 A | * | 5/1991 | Koizumi et al. | 346/140 |
| 5,036,337 A | * | 7/1991 | Rezanka | 346/1.1 |
| 5,107,276 A | * | 4/1992 | Kneezel et al. | 346/1.1 |
| 5,497,174 A | * | 3/1996 | Stephany et al. | 347/13 |
| 5,788,385 A | * | 8/1998 | Inoue et al. | 400/279 |
| 6,019,448 A | | 2/2000 | Yano et al. | 347/12 |
| 6,149,259 A | | 11/2000 | Otsuka et al. | 347/12 |
| 6,331,039 B1 | | 12/2001 | Iwasaki et al. | 347/11 |
| 6,334,660 B1 | * | 1/2002 | Holstun et al. | 347/19 |

FOREIGN PATENT DOCUMENTS

| | | |
|---|---|---|
| JP | 59-123670 | 7/1984 |
| JP | 59-138461 | 8/1984 |

* cited by examiner

*Primary Examiner*—Stephen D. Meier
*Assistant Examiner*—Lam S. Nguyen
(74) *Attorney, Agent, or Firm*—Fitzpatrick, Cella, Harper & Scinto

(57) ABSTRACT

An ink jet recording apparatus provides a plurality of recording heads arranged in a scanning direction, each having a plurality of nozzles arranged substantially perpendicular to the scanning direction, and records by discharging ink from the nozzles onto a recording medium by application of drive signals. The apparatus divides the plurality of nozzles among a plurality of blocks having a predetermined number of nozzles and sequentially drives each block so as to discharge ink within a discharge cycle. The apparatus has a column counter for counting a number of nozzles driven in a discharging cycle in each recording head, and a block counter for counting a number of nozzles driven in each block, and determines a pulsewidth of a heat signal for each recording head by a heat timing controller, based upon count values counted by the column counter and block counter.

22 Claims, 38 Drawing Sheets

SCANNING DIRECTION 2-1
to Y.M.C Head Vh
2-106
2-104
2-105
2-102
2-101
BLOCK DECODE
2-103
Vh 3-2
372
371
370
C Head enable
Y Head enable
M Head enable
Bk Head enable
373
C data
M data
Y data
Co_Clock
Co_Latch
3700
DATA TRANSFER CIRCUIT
temp
rank
3701
HEAT TIMING CONTROLLER
37-411
37-412
37-413
37-414
37-415
BLOCK COUNTER
3720
READ CONTROL CIRCUIT
3721
BLOCK DATA READ CIRCUIT
3704
37-17
37-16
37-15
37-14
37-211
37-212
37-13
37-12
37-11
3711
COLUMN COUNTER
WRITE CONTROL CIRCUIT
3712
3710
BLOCK DATA SELECTOR
3703
3702
TIMING CONTROL CIRCUIT
RAM
33-2
37
enc_a
enc_b

TEMPERATURE-CORRESPONDENT PULSE NO. TABLE

| HEAD INDEX | HEAD TEMPERATURE 25-30 | HEAD TEMPERATURE 30-35 | HEAD TEMPERATURE 35-40 | HEAD TEMPERATURE 40-45 |
|---|---|---|---|---|
| 114 | 0 | 0 | 0 | 1 |
| 115 | 1 | 1 | 1 | 2 |
| 116 | 2 | 2 | 3 | 3 |
| ... | ... | ... | ... | ... |
| 173 | 4 | 4 | 5 | 5 |

SET AT 40ms INTERRUPTION

TEMPERATURE-CORRESPONDENT PULSE NO.

PT00, PT01, PTM00 TABLE

| TEMPERATURE-CORRESPONDENT PULSE NO. | PT00 | PT01 | PTM00 |
|---|---|---|---|
| 0 | 10 | 48 | 82 |
| 1 | 10 | 48 | 83 |
| 2 | 10 | 48 | 84 |
| ... | ... | ... | ... |
| 43 | 10 | 48 | 100 |

1st=1/66us

FIG. 30

Bit_Vdown SETTING TABLE

| HEAD INDEX | VOLTAGE DROP LEVEL 0 | VOLTAGE DROP LEVEL 1 | ··· | VOLTAGE DROP LEVEL 13 |
|---|---|---|---|---|
| 114 | 11 | 26 | ··· | 161 |
| 115 | 11 | 25 | ··· | 160 |
| 116 | 11 | 24 | ··· | 158 |
| ··· | ··· | ··· | ··· | ··· |
| 173 | 9 | 22 | ··· | 154 |

SET WHEN HEAD IS MOUNTED

| VOLTAGE DROP LEVEL | 0 | 1 | ··· | 13 |
|---|---|---|---|---|
| Bit_Vdown | | | | |

FIG. 31

Ave_Vdown SETTING TABLE

| HEAD INDEX | VOLTAGE DROP LEVEL 0 | VOLTAGE DROP LEVEL 1 | ... | VOLTAGE DROP LEVEL 10 |
|---|---|---|---|---|
| 114 | 8 | 16 | ... | 78 |
| 115 | 8 | 16 | ... | 79 |
| 116 | 8 | 16 | ... | 80 |
| ... | ... | ... | ... | ... |
| 173 | 8 | 16 | ... | 84 |

SET WHEN HEAD IS MOUNTED

| VOLTAGE DROP LEVEL | 0 | 1 | ... | 10 |
|---|---|---|---|---|
| Ave_Vdown | | | | |

FIG. 36

Bit_All_Vdown SETTING TABLE

| HEAD INDEX | VOLTAGE DROP LEVEL 0 | VOLTAGE DROP LEVEL 1 | ··· | VOLTAGE DROP LEVEL 13 |
|---|---|---|---|---|
| 114 | 33 | 60 | ··· | 180 |
| 115 | 33 | 58 | ··· | 175 |
| 116 | 33 | 56 | ··· | 170 |
| ··· | ··· | ··· | ··· | ··· |
| 173 | 35 | 45 | ··· | 160 |

SET WHEN HEAD IS MOUNTED

| VOLTAGE DROP LEVEL | 0 | 1 | ··· | 13 |
|---|---|---|---|---|
| Bit_All_Vdown | | | | |

SUB-HEATER Vdown TABLE

| HEAD INDEX | LEVEL OF VOLTAGE DROP DUE TO SUB-HEATER ON |
|---|---|
| 114 | 1 |
| 115 | 1 |
| 116 | 2 |
| ... | ... |
| 173 | 10 |

SET WHEN HEAD IS MOUNTED

SUB-HEATER Vdown

RECORDING APPARATUS AND RECORDING CONTROL METHOD, AND INK JET RECORDING METHOD AND APPARATUS

FIELD OF THE INVENTION

The present invention relates generally to a recording apparatus that records using a recording head having a plurality of recording elements and a recording control method, and more particularly, to an ink jet recording method that records an image on a recording medium using a recording head that discharges ink from a plurality of discharge apertures and an apparatus for same.

BACKGROUND OF THE INVENTION

Serial recording apparatuses, which record an image by repeatedly scanning a recording head in a direction perpendicular to a direction in which a recording medium such as paper or an OHP sheet is transported, include wire dot, thermosensitive, thermal transfer and ink jet devices.

Of these serial recording apparatuses, the ink jet type records an image by spraying ink directly onto the recording medium, and has the advantage of low operating costs and low noise during recording. Additionally, in the ink jet system of image recording, a certain distance is maintained between the recording head and the recording medium, such that, typically, the two do not contact each other and the ink sprayed from the recording head and the recording medium so as to reach the recording medium and form a desired image. As a result, the frictional load of the carrier on which the printing head is loaded and scanned can be reduced, making it possible to achieve high printing speeds.

In the case of the above-described ink jet recording head, energy is needed to discharge the ink from the discharge apertures, that is, the nozzles. The amount of this energy varies depending on whether the density of the data to be recorded is high, that is, when a large volume of ink per unit area of the recording medium is discharged, or low, that is, when only a small volume of ink per unit area is discharged.

One method of supplying such required energy involves providing a heating element (that is, a heater) inside each nozzle of the recording head and passing an electric current through the heater so as to generate heat. The heat causes a bubble to form in the ink inside the nozzle, and the nearly instantaneous expansion of the bubble forces the ink out of the nozzle. Such delivery of energy to the recording head, that is, such delivery of electric power to the heater inside the nozzle, is effected via a cable that connects the recording head to the recording apparatus of the main unit. In such a cable, a slight amount of resistance in the wiring itself is present, so the electrical energy supplied via the cable experiences a loss due to that resistance. The size of the loss increases in proportion to the amount of energy supplied, and affects the drive state of the recording head. It should be noted that, in addition to the cable resistance itself, the operating states of the power circuit that supplies direct current power and of other circuit elements as well also change depending on the amount of energy supplied.

For example, in the case of an ordinary ink jet recording apparatus, the wire resistance between the recording apparatus main unit and the recording head is approximately 0.2 Ω and the head contact resistance is approximately 0.1 Ω, so the overall resistance is 0.3 Ω. If a drive current of 100–200 mA per recording element is then supplied and 54 recording elements are driven at the same time, then the overall current totals 2.4 to 4.8 A, and the voltage drop due to the wiring also totals 0.3 Ω×(5.4 A to 10.8 A)=1.62 to 3.24V, which is the voltage fluctuation that is applied to the recording elements.

Naturally, this voltage fluctuation applied to the recording elements translates into fluctuations in the energy with which the ink is discharged from the nozzle, in other words, causes fluctuations in the amount of ink discharged and in the speed at which the ink is discharged. As a result, unevenness occurs in the recording density, gaps arise in the positions at which the drops of ink are discharged onto the surface of the recording medium and sometimes the ink is not discharged properly at all, leading to marked deterioration in the quality of recording.

Additionally, although the voltage applied to the recording elements provided in the individual nozzles of the recording head differs due to the fact that ink is discharged simultaneously from a plurality of nozzles, the drive voltage and drive pulse are set so that the discharge of ink is steady even when ink is discharged simultaneously from a large number of nozzles, that is, when the drive voltage is at its maximum. Accordingly, when ink is discharged simultaneously from a small number of nozzles, the drive voltage and drive pulse applied to the recording elements are excessive, leading to excessive wear on the recording head.

In the typical recording operation, the amount of energy supplied to the recording head varies according to the density of the recorded data as described above, with the result that the accompanying drive states also differ. However, this sort of fluctuation in drive state is an obstacle to the attainment of a uniform recording result. Conventionally, in order to reduce this type of obstacle, a method is used whereby the amount of energy required is calculated and the amount of energy supplied is adjusted to an optimum energy level. It is possible, of course, to obtain the optimum energy amount by measuring physical quantities such as the actual voltage fluctuation, but an easier and more practical method involves counting the number of nozzles from which ink is to be discharged simultaneously using the data that is to be recorded, and from that count calculating the optimum amount of energy.

Moreover, as methods for adjusting the amount of energy supplied, it is possible to vary the drive voltage or to adjust the length of the heating. When changing the drive voltage itself, however, the structure of the circuitry tends to increase in scale, and for this reason it is common to use a drive circuit for the heater and to change the heating period, thereby adjusting the amount of energy supplied.

Additionally, in the recording head described above, the ink is discharged from the nozzle using heat generated by passing an electric current through the heater, so the recording head also generates heat during the process of recording. this increase in the overall temperature of the head is one factor that causes the drive state of the head to fluctuate, and must be taken into account as an element that, together with the above-described recording density, determines the amount of drive energy. Furthermore, differences in individual nozzle performance arising from slight production variations, such as variation in heater resistance value from one nozzle to the next, can also have an effect on the discharge of the ink. Thus the drive state is determined by a wide variety of elements. What is described above represents only the most typical examples, with recording control being exercised by the consideration of these factors to obtain the optimum drive state at any given time and adjust the amount of energy supplied accordingly, in order to obtain better-quality recording results.

Additionally, as personal computers (hereinafter sometimes referred to simply as PCs) have become faster, it has become possible to more easily handle large volumes of color image data, such that it is preferable to process large amounts of data when recording color images as well. Furthermore, the increasing fineness of recording images and increasing speed of processing makes it necessary to process ever larger amounts of image data at high speed. Increasing the speed of the recording operation in a serial-type ink jet recording apparatus like that described above can be achieved by increasing the number of cycles during which ink is discharged from the nozzles and by increasing the number of nozzles on the recording head. Enhanced fineness of the recorded image can be achieved by packing the recording head nozzles more densely together. However, such configurations tend to result in increasing numbers of nozzles to be driven per unit of time, and by increasing the number of nozzles to be driven per unit of time the number of nozzles involved in discharging ink simultaneously also increases, resulting in an increase in fluctuations in the drive state due to recording density as described above.

Additionally, in order to obtain highly detailed recording images, it is foreseeable that the degree of resolution required will differ depending on the recording color and contents. For example, there are cases in which it is best that the ink drops to be used for recording a photographic image differ from the ink drops to be used for recording an image that consists primarily of text. Accordingly, the same ink jet recording apparatus may have a plurality of recording heads of different resolutions. In a case in which a plurality of recording heads of different resolutions are used simultaneously, the timing of the discharge of the ink from the individual heads differs depending on the arrangement of the nozzles and the frequency with which the ink is discharged with respect to the distance over which the head is scanned. Also, as the size of the drops of ink discharged from the nozzles increases, so, too, does the amount of energy required to discharge the ink, with the result that the length of time required to heat each heater of each nozzle in order to discharge one drop of ink from an individual nozzle differs with each recording head.

Given these reasons, in the above-described structure, when an effort is made to calculate the number of nozzles driven simultaneously in a plurality of recording heads, because the individual recording heads are driven at different times it is difficult to determine how many nozzles are being driven at any one time. Additionally, when considering the energy supply side of the matter, in order to keep the cost of the device low it is necessary to supply electrical power to the individual recording heads using a single source of power. As a result, although it is necessary to determine the optimum amount of energy to be supplied not just to the recording density (drive state) of one recording head but to each of the several recording heads while taking into consideration the drive states of every other recording head, it has not been easy to do so.

Additionally and furthermore, the conventional art has the following types of problems which should be solved.

(1) It has not been possible to independently determine the voltage drop generated by the driving of the recording heads, the amount of the pulse current voltage drop in the path of the power wiring for the recording head and the voltage drop due to the smooth drive current that changes relatively smoothly.

(2) In the recording head, which is composed of a plurality of chips (head substrates), it has not been possible to independently determine the extent of the voltage drop in the wiring region common to all chips and the extent of the voltage drop in the individual wiring region of each chip.

Due to such problems, it has not been possible to determine accurately the extent of the voltage drop in the timing that drives the recording element.

At the same time, newer recording heads, which seek to achieve greater recording speeds by increasing the number of recording elements therein, also tend to continually increase the number of such recording elements that are driven at the same time. Accordingly, in order to accurately determine the extent of the voltage drop there is an increasing need to secure stable discharge of ink by performing appropriate pulse control.

SUMMARY OF THE INVENTION

The present invention was conceived with the above-described conventional examples in mind, and has as its object to provide an ink jet recording method and apparatus that improves the discharge characteristics of the ink by adjusting the drive state of the recording head in accordance with the drive states of the plurality of discharge apertures.

Another object of the present invention is to provide an ink jet recording method and apparatus that aligns a plurality of recording heads in a plurality of parallel lines in a scanning direction, and adjusts the drive state of the individual recording heads in accordance with the drive states of the plurality of discharge apertures in each recording head so as to be able to record better-quality images.

Yet another object of the present invention is to provide a recording control method and apparatus that makes long-term, stable recording possible.

Other features and advantages of the present invention will be apparent from the following descriptions taken in conjunction with the accompanying drawings, in which like reference characters designate the same or similar parts throughout the drawings.

BRIEF DESCRIPTION OF THE DRAWINGS

The accompanying drawings, which are incorporated in and constitute a part of the specification, illustrate embodiments of the invention and, together with the descriptions, serve to explain the principle of the invention.

FIGS. 4A and 4B show an arrangement of nozzles of the ink jet recording head according to a first embodiment of the present invention, in which FIG. 4A shows the arrangement of the nozzles of a recording head Bk for black ink and FIG. 4B shows the arrangement of the nozzles of the recording head of the recording head for color ink;

FIG. 30 shows a sample table defining 14 ranks of voltage drop levels corresponding to individual head indexes;

FIG. 31 shows an example of a table defining 11 ranks of voltage level drops of a smooth current portion 11 corresponding to individual head indexes;

FIG. 36 shows an example of a table defining 14 ranks of voltage drop levels of a joint pulse current portion corresponding to individual head indexes;

DESCRIPTION OF THE PREFERRED EMBODIMENTS

A detailed description will now be given of preferred embodiments of the present invention, with reference to the accompanying drawings.

Figure 1:
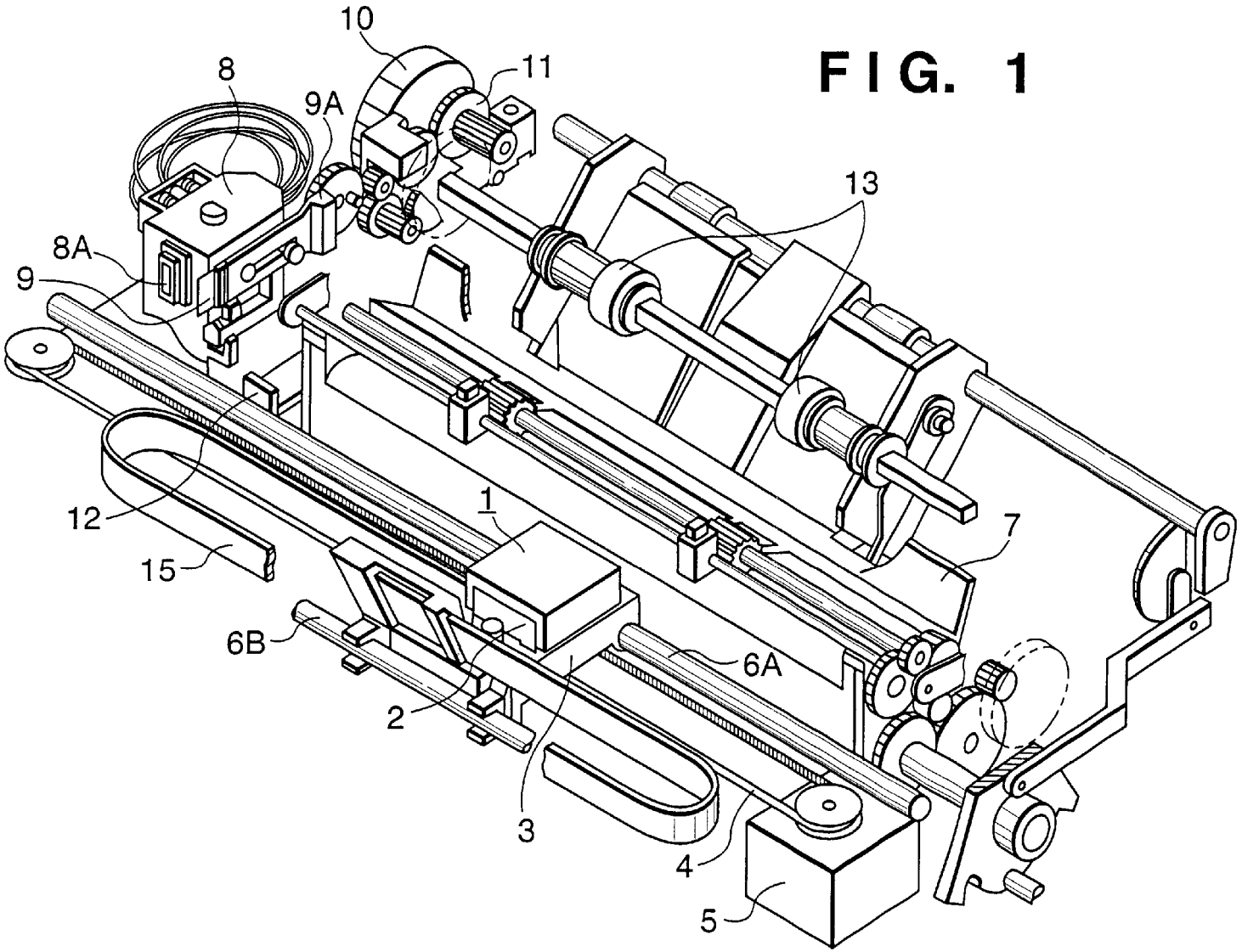
FIG. 1 is a perspective view of major parts of the ink jet recording apparatus according to an embodiment of the present invention.

FIG. 1 is a perspective view of major parts of the ink jet recording apparatus according to one embodiment of the present invention.

In the diagram, reference numeral 1 denotes a head unit formed by forming an ink tank (not shown in the diagram) and an ink jet recording head 2 into a single integrated unit. Numeral 3 denotes a carriage, mounting the head unit 1 which is provided with four ink jet recording heads that record in color: Bk (black) head 2-1, Y (yellow) head 2-2, M (magenta) head 2-3 and C (cyan) head 2-4 (see FIG. 3). Furthermore, the carriage 1 is linked to a portion of a drive belt 4 that transmits a rotary drive force of a carriage drive motor 5, and moreover, is movably mounted with respect to guide shafts 6A, 6B positioned parallel to a scanning direction. The rotation of the carriage drive motor 5 causes the ink jet recording heads 2-1, 2-2, 2-3, 2-4 to move back and forth across along a platen 7 disposed opposite the ink ejection surface, so as to travel across an entire surface of a recording sheet (a recording medium) supplied from a medium feed apparatus not shown in the drawing and carry out recording to the head sheet.

Each of the individual ink jet recording heads 2-1 through 2-4 is provided with a plurality of tube-like nozzles that discharge ink onto a recording surface of a recording sheet. Additionally, heaters are provided near the mouths of the nozzles in order to provide the energy to discharge the ink which is supplied to the nozzles from ink tanks attached to each of the recording heads by tubes. The heaters will be described in more detail later, with reference to FIG. 2. Additionally, the rows of nozzles of the recording heads 2-1 through 2-4 are arranged substantially perpendicularly to the scanning direction of the carriage 3. Further, these four recording heads are disposed along the scanning direction of the carriage 3.

Reference numeral 8 denotes a head recovery unit having a head cap 8A that covers an ink discharge surface of the recording head 2. The operation of a sheet feed motor 10 and clutch 11 acting via a drive part 9A moves the head recovery unit 8 in a head position direction, such that the head recovery unit 8 is movable between a head recovery position, where capping and/or suction of the nozzles of the recording heads is performed, and a ready position, where the head recovery unit 8 does not contact any recording head 2. Numeral 12 denotes a projection for detecting the position of the carriage 3, which engages a photosensor (not shown in the diagram) provided on the head carriage 3 so that it can be determined whether or not the carriage 3 is at the head recovery position or not. When the recording sheet (recording medium) is fed forward, a rotation of the sheet feed motor 10 is transmitted to the transport roller 13 via the clutch 11 so that it is possible to transport the recording sheet in the sub-scanning direction.

It should be noted that the recording head unit 2 is provided with a position encoder sensor 14 (see FIG. 3) for detecting the scanning position of the carriage 3. When the carriage 3 moves along the guide shafts 6A, 6B, the encoder sensor 14 reads a code of an interval recorded on an encoder film (not shown in the diagram) and uses the code to carry out position detection of the carriage 3 in the main scanning direction. Furthermore, a signal from the encoder sensor 14 is used to generate a trigger signal that regulates ink discharge timing.

It should be noted that the reference position of the carriage 3 during the recording operation is determined as described below. Initially, an initialization sequence performed when the electric power is first turned on moves the carriage 3 to the limits of the possible range of movement of the carriage 3. When the carriage 3 can move no further the signals from the position encoder 14 terminate, and this cessation is used to determine the relative position of the carriage 3, after which the reference position of the carriage 3 is determined based on the signals from the encoder 14.

The above-described ink jet recording apparatus reads in data such as image information, control commands, etc., input from an external host unit 41 (see FIG. 3) or the like at a control unit 30 to be described later, and in accordance with that read-in data proceeds to the image data for individual colors, which is then forwarded to the respective corresponding ink jet recording heads 2-1 through 2-4. At the same time, the ink jet recording apparatus rotatably drives the carriage drive motor 5, causing the carriage 3 to scan and discharging ink at respective desired time intervals, thereby performing a series of recording operations.

It should be noted that the control unit 30 and the carriage 3 are connected to each other by a flexible cable 15. The recording heads are supplied via the cable 15 with a variety of signals and with the electric power necessary to discharge the ink.

Additionally, although the head unit 1 employed in the ink jet recording apparatus described above is one in which the ink tank and the recording head 2 are formed into a single integrated unit, it is also possible to employ a head unit in which the ink tank and the recording head 2 can be separated. Moreover, it is also possible to use a recording head in which the nozzles that discharge ink of multiple colors form a single integrated unit, such that it is possible to discharge ink of many colors from a single recording head.

Figure 2:
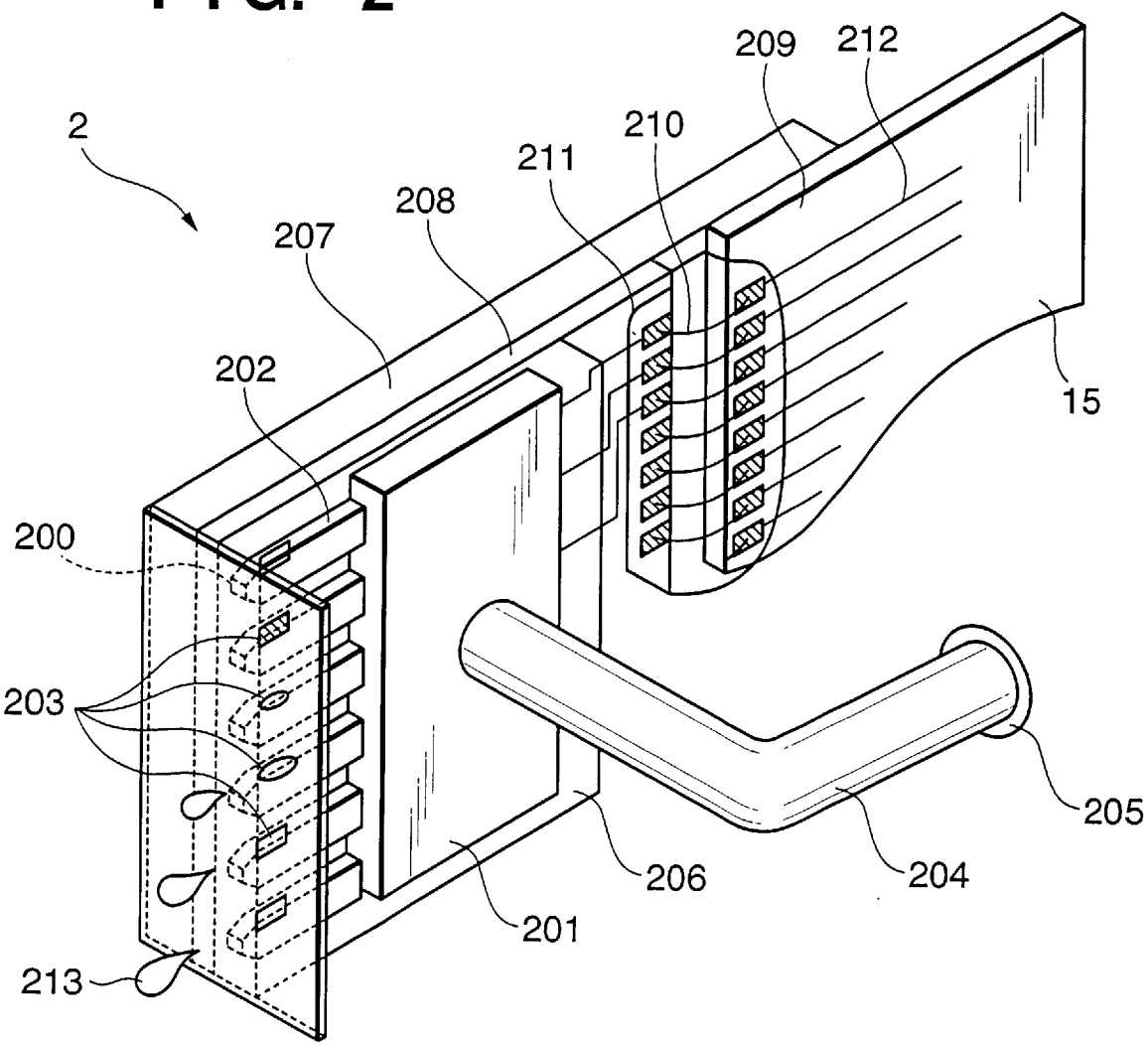
FIG. 2 is a perspective view of major parts of the recording head according to the embodiment of the present invention.

FIG. 2 is a perspective view of the essential elements of one of the recording heads 2-1 through 2-4 shown in FIG. 1. It should be noted that each of the four recording heads 2-1 through 2-4 has basically the same basic structure as any of the others.

As shown in FIG. 2, a plurality of nozzles 200 of different predetermined pitches are formed on each of the recording heads. Additionally provided are a joint fluid chamber 201 and recording elements (heat-generating elements) 203 for generating the energy needed to discharge the ink along the wall surfaces of the individual flow paths that connect the joint fluid chamber 201 and the individual nozzles 200. These recording elements 203 and their drive circuits are formed atop a silicon substrate 208 using semiconductor manufacturing techniques. The silicon substrate 208 is then attached to a heat-dissipating aluminum base plate 207. Additionally, a circuit connecting part 211 atop the silicon substrate 208 and a printed board 209 are connected by ultra-thin wire 210, so that signals from the recording apparatus main unit pass through a signal circuit 212 such as the flexible cable 15 described previously.

The flow path 202 and the joint fluid chamber 201 are formed by a plastic cover 206 made by extrusion formation. The joint fluid chamber 201 is linked with the ink tank via a joint tube 204 and an ink filter 205, so that ink is supplied to and temporarily stored in the joint fluid chamber 201 from the ink tank. By capillary action, the ink that is supplied from the ink tank to the joint fluid chamber 201 invades the flow path 202 and forms a meniscus at the nozzle 200, thus keeping the flow path in a full state. At this time the drive circuit atop the silicon substrate 208 passes an electric current through the recording elements 203 and thus causes the recording elements to generate heat, which in turn causes the ink on the recording elements 203 to heat up rapidly, forming a bubble inside the flow path 202. The expansion of this bubble causes a drop of ink 213 to be discharged from the nozzle 200.

A description will now be given of the construction of the ink jet recording apparatus according to the present embodiment, with reference to FIG. 3.

Figure 3:
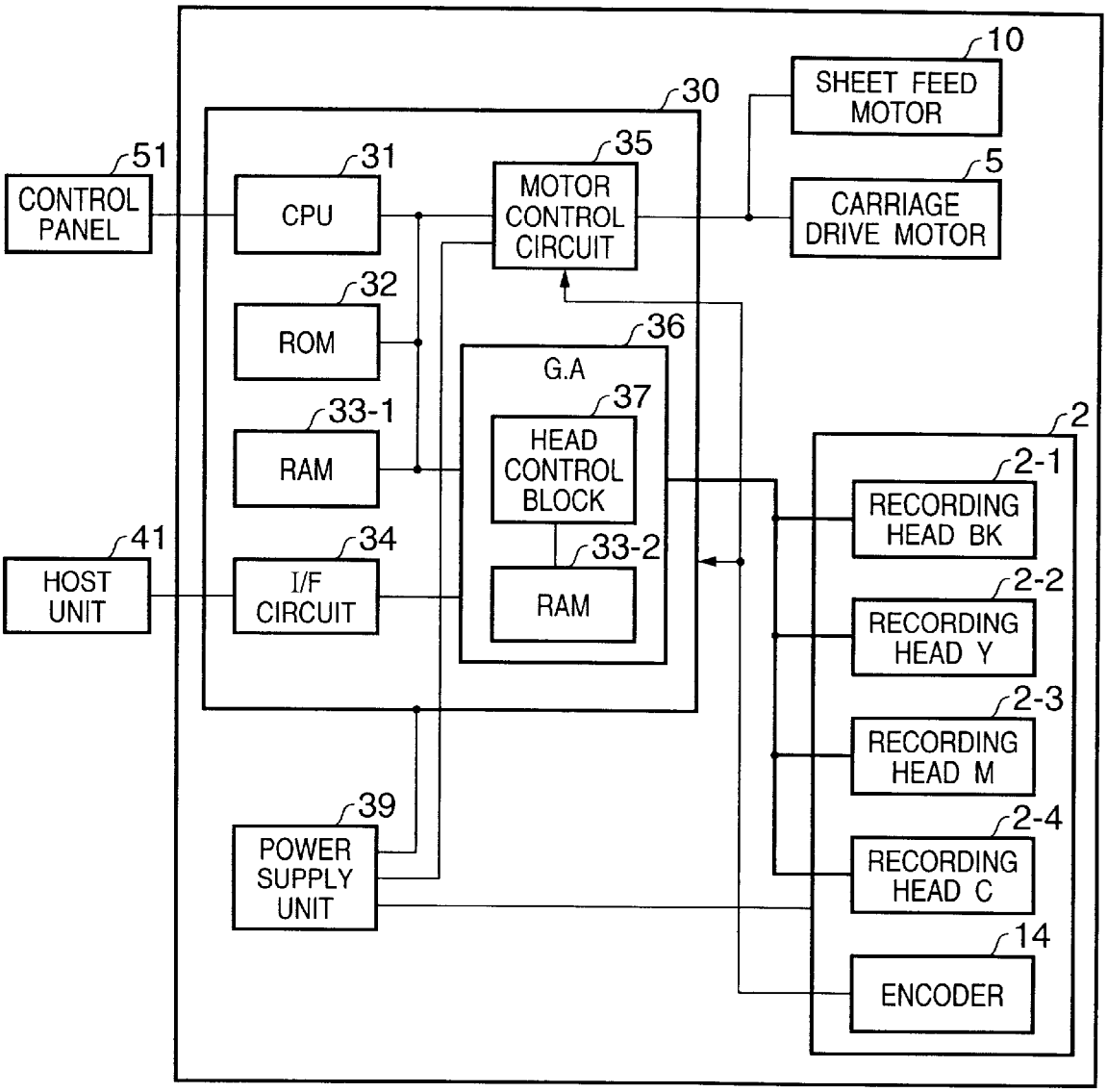
FIG. 3 is a block diagram showing the functional composition of the ink jet recording apparatus according to the embodiment of the present invention.

FIG. 3 is a block diagram showing the functional construction of the ink jet recording apparatus according to the first embodiment of the present invention. In FIG. 3, the control unit 30 comprises a central processing unit (CPU) 31, ROM 32 that stores a variety of data and programs that are executed by the CPU 31, a RAM 33-1 that temporarily stores a variety of data, and interface (I/F) circuit 34 that transfers data to and from a host unit 41 that is an external device, a motor control circuit 35 that rotatably drives the carriage drive motor 5 and the sheet feed motor 10, and a gate array 36 that is provided with a logic circuit that performs a variety of controls auxiliary to the operation of the CPU 31. The gate array 36 is provided with a head control block 37 that carries out control and drive of the discharge timing of the ink jet recording head 2 and a RAM 33-2. Reference numeral 39 denotes an electric power supply unit that supplies electrical power to the ink jet recording head apparatus as a whole.

It should be noted that a DC motor is employed for the carriage drive motor 5. The gate array 36 transmits an operating signal of the carriage drive motor 5 to the motor control circuit 35 in order to move the carriage 3 in response to an instruction from the CPU 31. At the same time, a signal from the position encoder sensor 14 mounted on the carriage 3 allows a user to know at what position the carriage 3 is located by managing the number of signals from the reference position of the scanning direction of the carriage 3. When the carriage 3 approaches the recording area, the processing of data necessary to the recording operation commences. Further, as the carriage 3 moves and the recording heads 12-1 through 12-4 mounted on the carriage 3 arrive at the position at which ink is to be discharged, the head control block 37 acts to control the discharge of ink from the individual recording heads.

The CPU 31 controls the entire operation of the ink jet recording apparatus according to the control commands input from the programs previously stored in the ROM 32 or from the host unit 41 via the interface circuit 34. The ROM 32 contains programs that the CPU 31 operates as well as a variety of table data needed to control the drive of the recording head 2. The control panel 51 is provided with the settings for the ink jet recording apparatus, for example, a variety of key switches for carrying out a variety of settings such as on-line/off-line operation, sheet feed, and so forth, as well as LEDs for indicating a power ON state, and on-line state, the occurrence of an error, and so forth. The interface circuit 34 is an interface unit for the purpose of inputting and outputting control commands and control data from the host unit 41 to the ink jet recording head.

The RAM 33-1 is used as a work area for CPU 31 calculations and controls, or a temporary storage area for recording data and control commands input from the host unit 41 via the interface circuit 34. Additionally, the RAM 33-1 is also used as a print buffer for storing image data consisting of recording data converted to bit data corresponding to a nozzle position of the recording head 2. Additionally, the RAM 33-2 is provided inside the gate array 36, and contains image data corresponding to the nozzles of each block so as to input image data developed to the above-described RAM 33-1 print buffer, divide the plurality of nozzles of each recording head among a plurality of blocks time-shared driven. The image data stored in the RAM 33-2 is then transmitted as it is, to the recording heads 2-1 through 2-4 to directly constitute data for thermally driving the heating elements (recording elements) of the individual nozzles.

A description will now be given of an arrangement of the nozzles of the recording head of the ink jet recording apparatus of the present embodiment, with reference to FIGS. 4A and 4B.

Figure 4A:
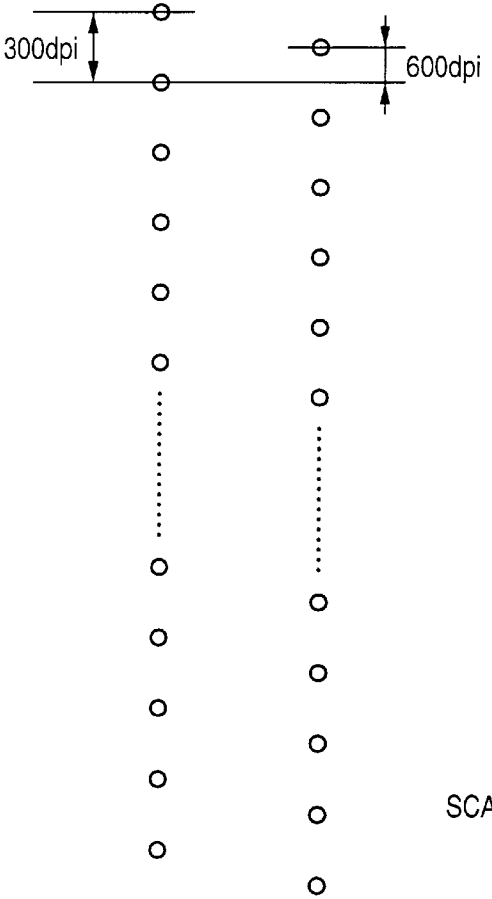
Figure 4B:
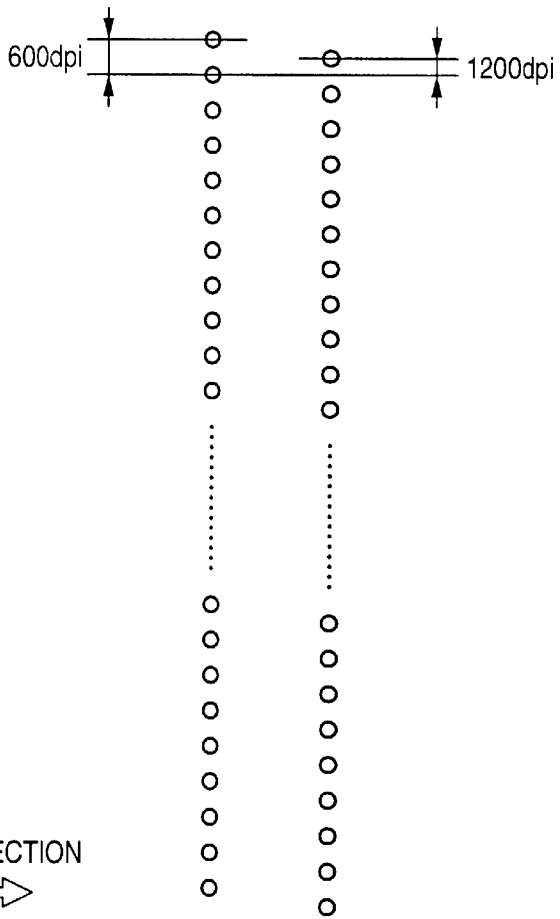

FIG. 4A shows the arrangement of the nozzles of a recording head (Bk) 2-1 for black ink. FIG. 4B shows the arrangement of the nozzles of the recording head of the recording heads 2-2 through 2-4 for color ink.

The recording head 2-1 according to the present embodiment is provided with two rows of 324 nozzles arranged at a pitch of 300 dpi, for a total of 648 nozzles. The two rows of nozzles are disposed so as to be offset in a vertical direction by ½ a pitch (600 dpi), with recording carried out by the drops of ink being discharged from each of the nozzle rows onto a recording medium, such that the resolution is 600 dpi in the sub-scanning direction. From the arrangement of the nozzles in rows corresponding to the dot positions that comprise the resulting recording, the individual nozzle rows are called ODD and EVEN, respectively, such that, for example, in FIG. 4A, the row on the left is the ODD row and the row on the right is the EVEN row. The same arrangement occurs with the color recording heads 2-2 through 2-4 shown in FIG. 4B.

The individual nozzles arranged on the recording head 2-1 are sequentially driven in fixed cycles whose lengths are determined by the time required to supply the ink and the heating time required to discharge the ink, such that every nozzle discharges ink once during the cycle.

It should be noted that the recording head 2-1 is mounted on the carriage 3, and discharges ink drops while being transported in a direction substantially perpendicular to the direction in which the recording sheet that is the recording medium is transported. At this time, the need to disperse the supply of energy needed to supply and to discharge the ink dictates that drops of ink are not to be discharged form every nozzle in each of the two rows at the same time. Instead, the 324×2=648 nozzles are divided into 12 blocks (54 nozzles/block) per discharge cycle, so that sequential discharge of ink is accomplished in block units, that is, on a per-block basis, in one discharge cycle.

As described above, FIG. 4B shows the arrangement of nozzles of any one of the color heads 2-2 through 2-4 of the ink jet recording apparatus of the present embodiment. It is to be understood that the structure of each of the color recording heads is the same as that of any other color recording head.

In the present embodiment, the recording head C (2-4), recording head M (2-3) and recording head Y (2-2) that discharge the color ink each have the same structure, with 648 nozzles disposed at 600 dpi pitch arranged in two rows. As with the black ink recording head 2-1 described above, the two rows of nozzles are disposed so as to be offset ½ pitch (1200 dpi) in the vertical direction with respect to each other. The drops of ink discharged from each of the nozzle rows are attached to the recording medium at an interval of 1200 dpi in the sub-scanning direction as a result, thus forming the image. The color recording heads 2-2 through 2-4 are mounted on the carriage 3, and discharge ink while being transported in a direction substantially perpendicular to the direction in which the recording sheet that is the recording medium is transported. At this time, the need to disperse the supply of energy needed to supply and to discharge the ink dictates that drops of ink are not to be discharged from every nozzle in each of the two rows at the same time. Instead, the 648×2=1296 nozzles are divided into 24 blocks (54 nozzles/block) per discharge cycle, so that sequential discharge of ink is accomplished in block units, that is, on a per-block basis, in one discharge cycle.

It should be noted that the nozzle blocks of the individual recording heads of the embodiments described above consist of 54 nozzles per block no matter what the configuration. Additionally, nozzles of the same block are divided into ODD rows and EVEN rows of 27 nozzles each (54 divided by 2) so that the nozzles, which are dispersed evenly, do not easily affect each other during discharge of ink.

Figure 5:
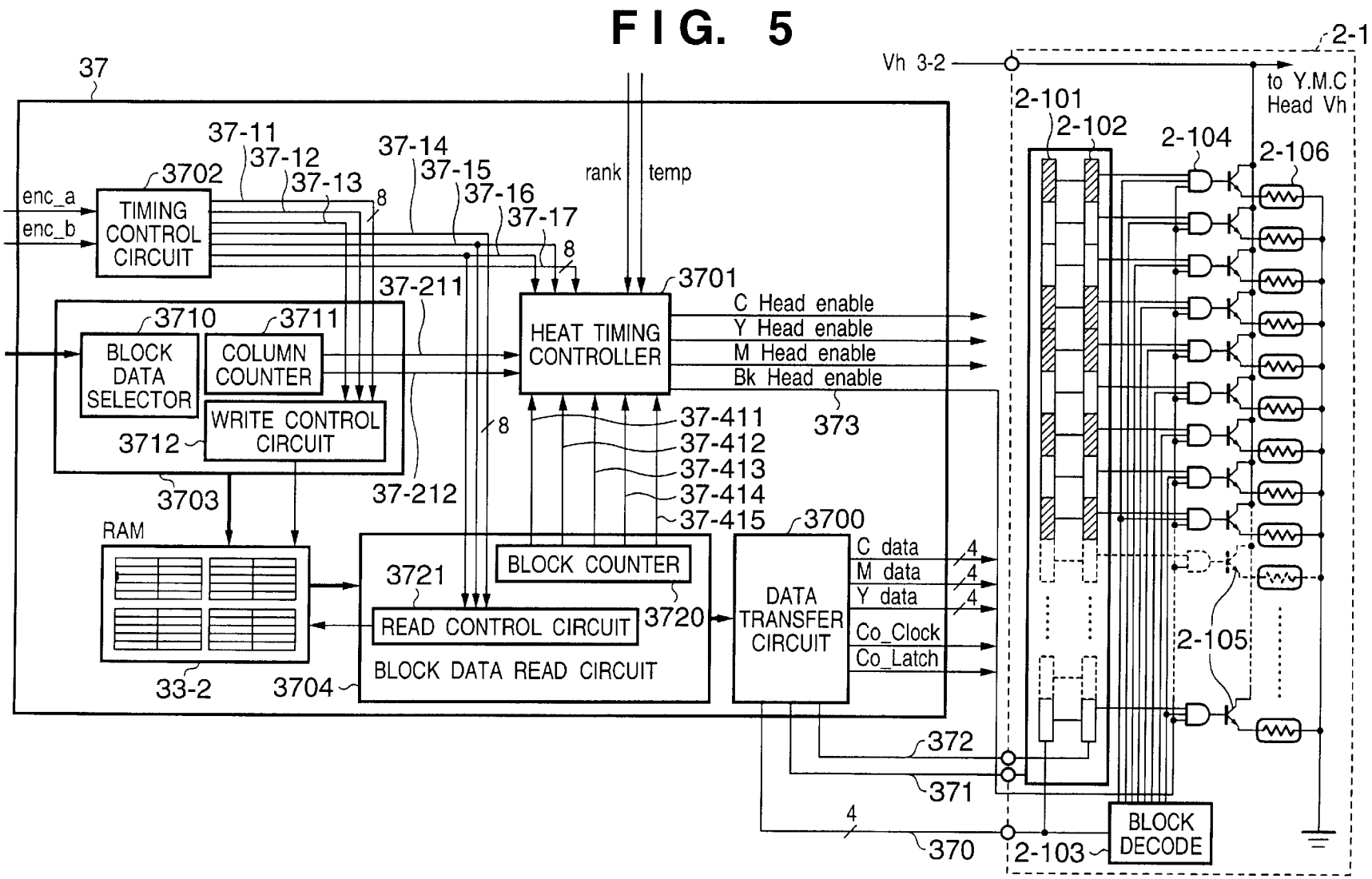
FIG. 5 is a block diagram showing a composition of a drive part of a recording head of an ink jet recording apparatus according to the embodiment of the present invention.

FIG. 5 is a block diagram illustrating a discharge circuit and a discharge control of a recording head of a recording apparatus according to the present embodiment. It should be noted that although the ink jet recording apparatus mounts four separate recording heads comprising Bk, C, M and Y (2-1 through 2-4), the operating principle of each of the recording heads is fundamentally the same, and so the description given here is limited to the recording head 2-1 (Bk).

A data transfer circuit 3700 in a head control block 37 transfers image data (that is, discharge drive data) read from the RAM 33-2 to the respective corresponding recording heads. The transfer of data to the recording head 2-1 by the data transfer circuit 3700 is carried out using data signals 370, clock signal 371 and latch signal 372. The data signals 370 are 4-bit data signals, and are synchronized with the clock signal. The data signals 370 are sequentially transferred to and stored in a shift resistor 2-101 provided on the recording head 2-1. It is these data signals 307 that determine from which nozzles the ink is to be discharged. When the transfer of data pertaining to the number of nozzles to be activated per block as well as block designation data is completed, the latch signal 372 is transmitted. The transmission of the latch signal 372 causes the image data stored in the shift register 2-101 to be transferred to the latch circuit 2-102, where it is held. It should be noted that data transmission to the color recording heads 2-2, 2-3 and 2-4 (recording heads 2-2 through 2-4) is carried out via respective 4-bit Cdata, Mdata and Ydata. The transfer clock signal is $C_0$ Clock and the latch signal is $C_0$ Latch.

When the transfer of all the relevant data to the recording head 2-1 is completed, heat signals for each of the recording heads (in this case a Bk Heat enable signal for the recording head 2-1) is transmitted from a heat timing controller 3701 in accordance with the scanning position of the carriage. At this time, a block decoder 2-103 according to a 5-bit block selection signal transferred as a data signal 307 selects one of the nozzle blocks of the recording head 2-1 (the recording head 2-1 having 12 nozzle blocks consisting of 54 nozzles each). The nozzle block thus selected is activated according to the image data by an output from the AND circuit 2-104 of that block.

The inputting of a heat signal 373 to that group of nozzles for which data has been set and the block selected in accordance with the above-described sequence activates the drive transistor 2-105 that is connected to the AND circuit 2-104 for which the output condition is satisfied, that is, for which the block is selected and the recording data is "1", thus triggering the flow of a heat current to the heater resistor 2-106 of the corresponding nozzle. The heat signal 373 is ultimately used as a signal that drives the discharge drive transistors 2-105, controlling the timing of the discharge of ink from the nozzles. At the same time, in order to adjust the amount of energy supplied to the heater resistor (heating elements) 2-106, the heat signal 373 is used to control the heating time of the heater resistors 2-106.

It should be noted that the heat signals for the color recording heads 2-2 through 2-4 are C Heat enable, M Heat enable and Y Heat enable, respectively.

The above-described operations are controlled by the control unit 30, based on the trigger signals produced by a timing control circuit 3702 from the signals from the position encoder 14 mounted on the carriage 3, and from a window signal that indicates position information.

Figure 6:
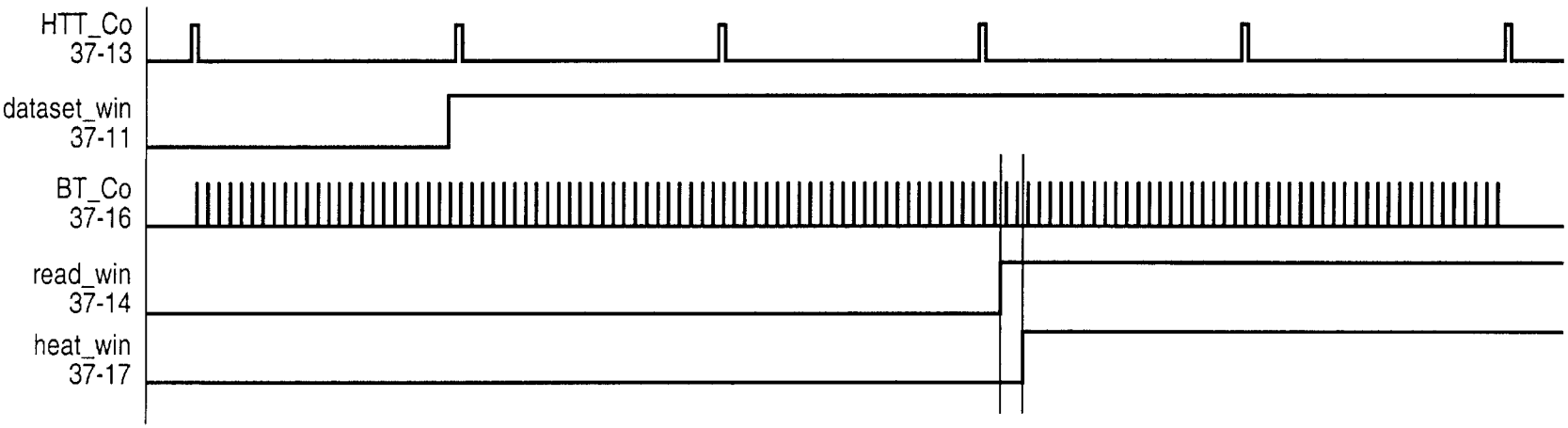
FIG. 6 is a timing chart showing trigger signals and window signals for the color recording head according to the first embodiment of the present invention.

FIG. 6 is a timing chart showing trigger signals and window signals for the color recording heads 2-2, 2-3 and 2-4.

HTT_$C_0$ signal 37-13 is a color recording head heat trigger signal and BT_$C_0$ signal 37-16 is color recording head block trigger signal. The dataset_win signal 37-11 indicates a data set window used to set color image data for the RAM 33-2, the read_win signal 37-14 is likewise used to read color image data from the RAM 33-2, and the heat_win signal 37-17 indicates an 8-bit heat window used to activate the color recording heads. The individual window signals operate under an AND condition in tandem with their corresponding trigger signals. Since the data processing operations are conducted in parallel, the respective window signals depicted in the diagram are synchronized with the scan of the carriage 3 and are activated as necessary to control the circuit block drive timing. Additionally, the window signals are each 8-bit signals, and all are output from the timing control circuit 3702.

In FIG. 6, the block trigger signal 37-16 is output 24 times during one discharge cycle (one cycle of the heat trigger signal 37-13) because, as described above, in the color recording heads discharge of the ink is apportioned among 24 blocks per discharge cycle.

As described above, the color recording heads are each provided with ODD and EVEN rows of nozzles, disposed parallel to the scanning direction of the carriage 3. The processing of discharge data for the nozzles is carried out sequentially, in tandem with the scanning of the carriage 3. This data processing is carried out in units of eight rows of nozzles, that is, the 2 rows (ODD/EVEN) multiplied by the 4 colors (including black). Accordingly, each of the eight bits of the heat window signal heat_win 37-17 corresponds to one of the rows of nozzles.

Figure 7:
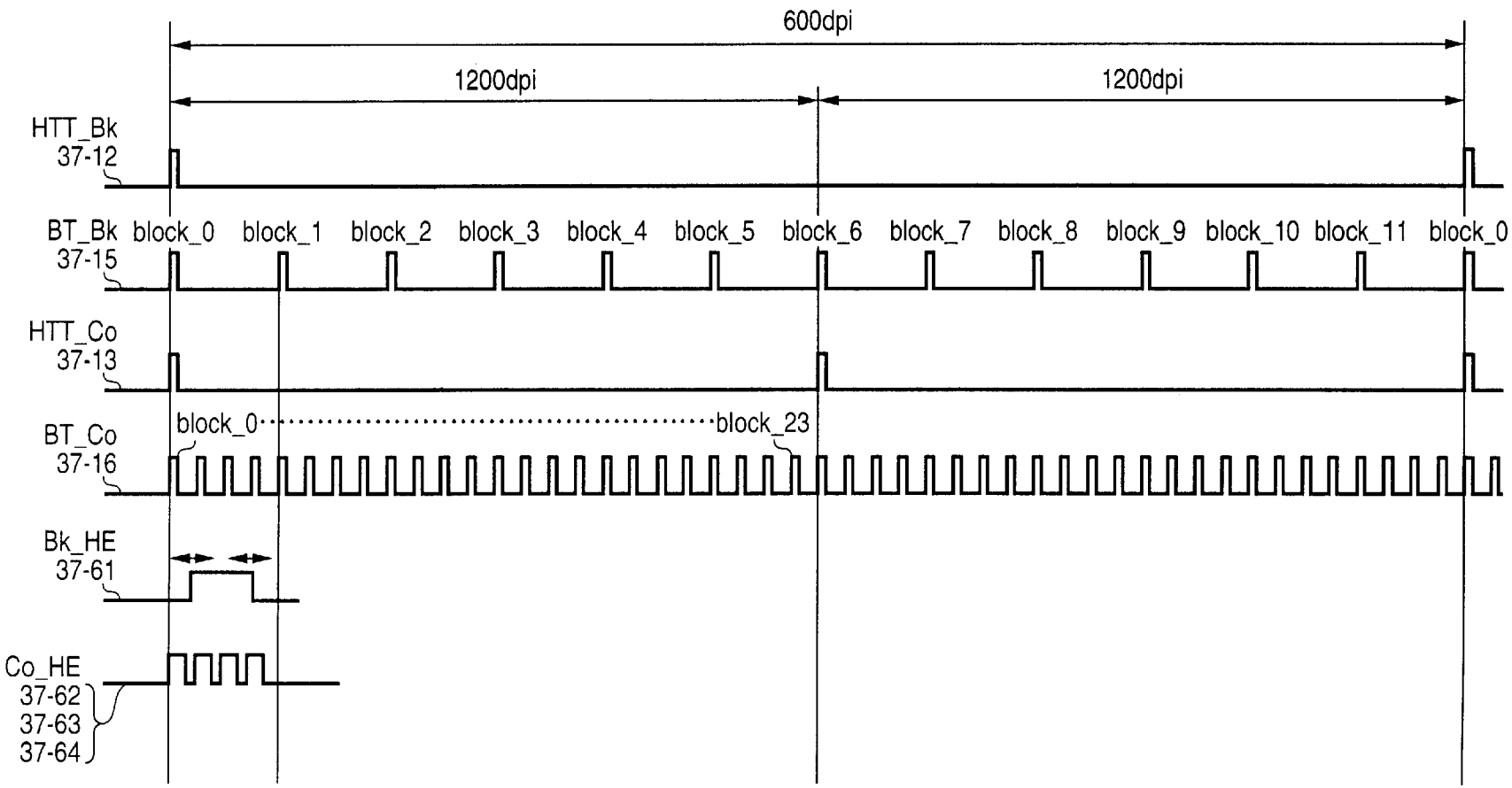
FIG. 7 is a diagram showing a relationship between a heat trigger and a block trigger according to the first embodiment of the present invention.

FIG. 7 is a diagram showing the relation between the heat trigger signals and the block trigger signal for the black recording head 2-1 as well as the color recording heads 2-2, 2-3 and 2-4.

HTT_Bk signal 37-12 is the heat trigger signal for the black recording head 2-1, HTT_$C_0$ signal 37-13 is the heat trigger signal for the above-described color recording heads, BT_Bk signal 37-15 is the block trigger signal for the recording head 2-1 and BT_$C_0$ signal 37-16 is the block trigger signal for the above-described color recording head. These trigger signals are used to trigger operation of the circuit blocks when ANDed with the above-described window dataset_win signal 37-11, the read_win signal 37-14 and the heat_win signal 37-17.

The heat trigger signals HTT indicate the discharge cycles. The block trigger signals BT are signals that divide the heat trigger cycle by the number of recording head blocks. Thus, for example, the block trigger signal BT_Bk 37-15 for the recording head 2-1 is generated at 12 discrete intervals within the cycle (discharge cycle) of the heat trigger signal HTT_Bk 37-12. Similarly, the color recording head block trigger signal BT_$C_0$ 37-16 is generated at 24 discrete intervals within the cycle (discharge cycle) of the color recording head heat trigger signal HTT_$C_0$ 37-13. It should be noted that the respective block trigger signals (BT_Bk, BT_$C_0$) for any given cycle are calculated using the preceding cycle's heat trigger signal.

Bk-HE signal 37-61 is a heat enable signal for the black recording head 2-1, and is a drive signal for the recording head 2-1 that is activated by the block trigger signal 37-15. $C_0$_HE signals 37-62, 37-63 and 37-64 are drive signals for the color recording heads 2-2, 2-3 and 2-4, respectively. As shown in FIG. 7, differences in resolution, number of nozzles and number of blocks of the recording heads means that, during one discharge of the black recording head 2-1, the color recording heads 2-2, 2-3 and 2-4 carry out four ink discharge operations.

The pulsewidth of the heat pulse that drives the heating elements 2-106 of the recording heads to generate heat is controlled separately for each of the recording heads 2-1, 2-2, 2-3 and 2-4, by a process to be described later that includes temperature control and head rank. This variation in the heat pulsewidth is one reason the number of nozzles that are driven to discharge ink simultaneously is not predetermined.

A description will now be given of a method and composition for detecting the recording density and controlling the amount of energy imparted to each head.

In FIG. 5, numeral 3703 denotes a RAM write circuit, writing data to the RAM 33-2 in columns (a nozzle row of a recording head), numeral 3704 denotes a RAM read circuit, which reads data from the same RAM 33-2 in blocks, and numeral 3700 denotes a data transfer circuit, transmitting data to the recording heads.

The RAM write circuit 3703 is provided with a write control circuit 3712 that carries out write control, including address control, for a block data selector 3710 that divides the image data from the preceding stage in units of nozzle rows the into units of blocks, a column counter 3711 that counts the number of dots in the data of the column units, and the RAM 33-2. The RAM write circuit 3703 is activated when the data set window signal dataset_win 37-11 and the heat trigger signals HTT_Bk 37-12 (for black) and HTT_$C_0$ 37-13 (for color) are ANDed, and processes data for each color in units of one column. Additionally, simultaneous with writing of data to the RAM 33-2, the RAM write circuit 3703 is also provided with a function that counts and retains the number of pieces of data per column.

The RAM 33-2 comprises 40 separate RAM areas, that is, five areas for storing image data corresponding to each of the eight nozzle rows of the four recording heads. The five regions per nozzle row act as a buffer, absorbing actual differences in the timing of the writing to the RAM 33-2 and in the timing of the heating of the heating elements of the nozzles. The 40 RAM areas are divided among 24 addresses corresponding to the number of blocks on the individual recording heads.

The RAM read circuit 3704 is provided with a read control circuit 3721 that controls the reading of data from the block counter 3720 that counts the block unit image data as well as the RAM 33-2, including read address management. The read control circuit 3721 is activated when the block trigger signals Bt_Bk 37-15 (for black) and BT_$C_0$ 37-16 (for color) as well as the read window signal read_win 37-14 are ANDed, and reads image data for each color in units of blocks from the RAM 33-2. The image data thus read from the RAM 33-2 is then sent to the data transfer circuit 3700, where it is forwarded to the recording heads.

Recording is carried out in parallel, that is, simultaneously, for each color. Accordingly, during normal operation a plurality of windows are open when the trigger signals are input. The circuit blocks latch onto the open windows when the trigger signals are input and complete color data processing by the time the next trigger signal is input.

Figure 8:
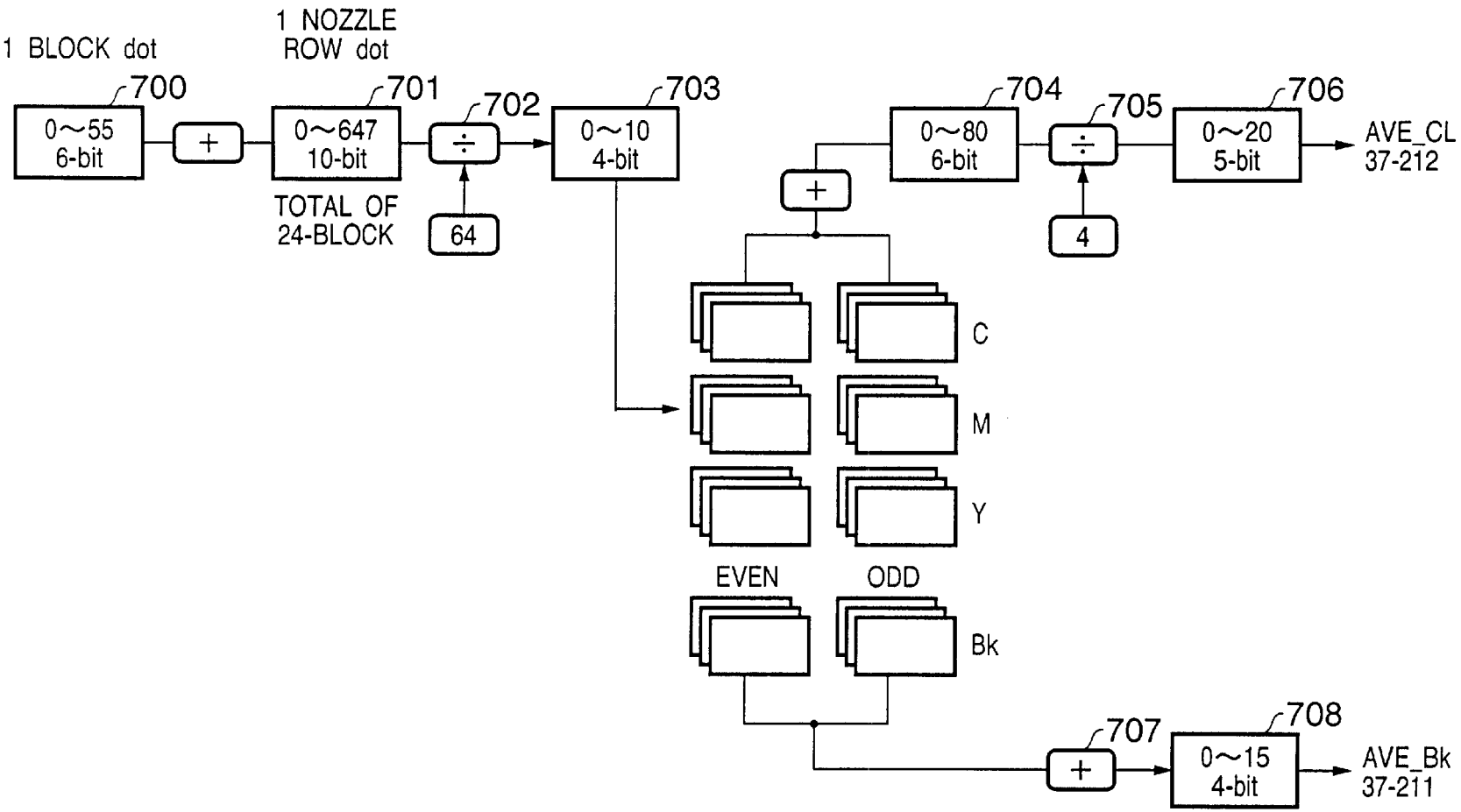
FIG. 8 is a schematic diagram showing a functional composition of a column counter according to the first embodiment of the present invention.

FIG. 8 is a schematic diagram illustrating a functional composition of a column counter according to a first embodiment of the present invention.

As shown in the diagram, a column counter 3711 counts the number of recording data (that is, the number of dots to be recorded) per block (54 nozzles) in a step 700, and, on the basis of the count made in the step 700, counts how many dots of recording data there are for the 648 dots (324 in the case of the black recording head 2-1) of each nozzle row in a step 701. The number of data to be recorded per row of nozzles as counted in the step 701 is then divided by 64 (6-bit shift) in a step 702, rounded, and retained as 4-bit data in a step 703. Since the RAM 33-2 has five areas for storing recording data corresponding to the eight nozzle rows of the four recording heads as described above, the data for each nozzle row can be saved in chunks of 5 each.

The recording data for each color that is retained in the RAM 33-2 as described above is selected and read in tandem with the ink discharge timing and the sum of a total of 6 rows, that is, the ODD and EVEN rows of the recording heads Y2-2, M2-3, C2-4 driven simultaneously (6 bit: step 704) is obtained. This sum is then divided by 4 in a step 705 and the result is output as a 4-bit data value (AVE_CL 37-212) in a step 706. This value is the average number of dots driven per nozzle row for the color recording heads.

Additionally, values for the ODD row and EVEN row of the black recording head 2-1 (obtained in step 703) are added together in a step 707, and the resulting 4-bit data value (AVE_Bk 37-211) obtained in a step 708 becomes the average number of dots per nozzle row for the black recording head 2-1. This average value is used by the heat timing controller 3701 to determine the pulsewidth of the heat pulse when driving the nozzle rows of the recording heads.

Figure 9:
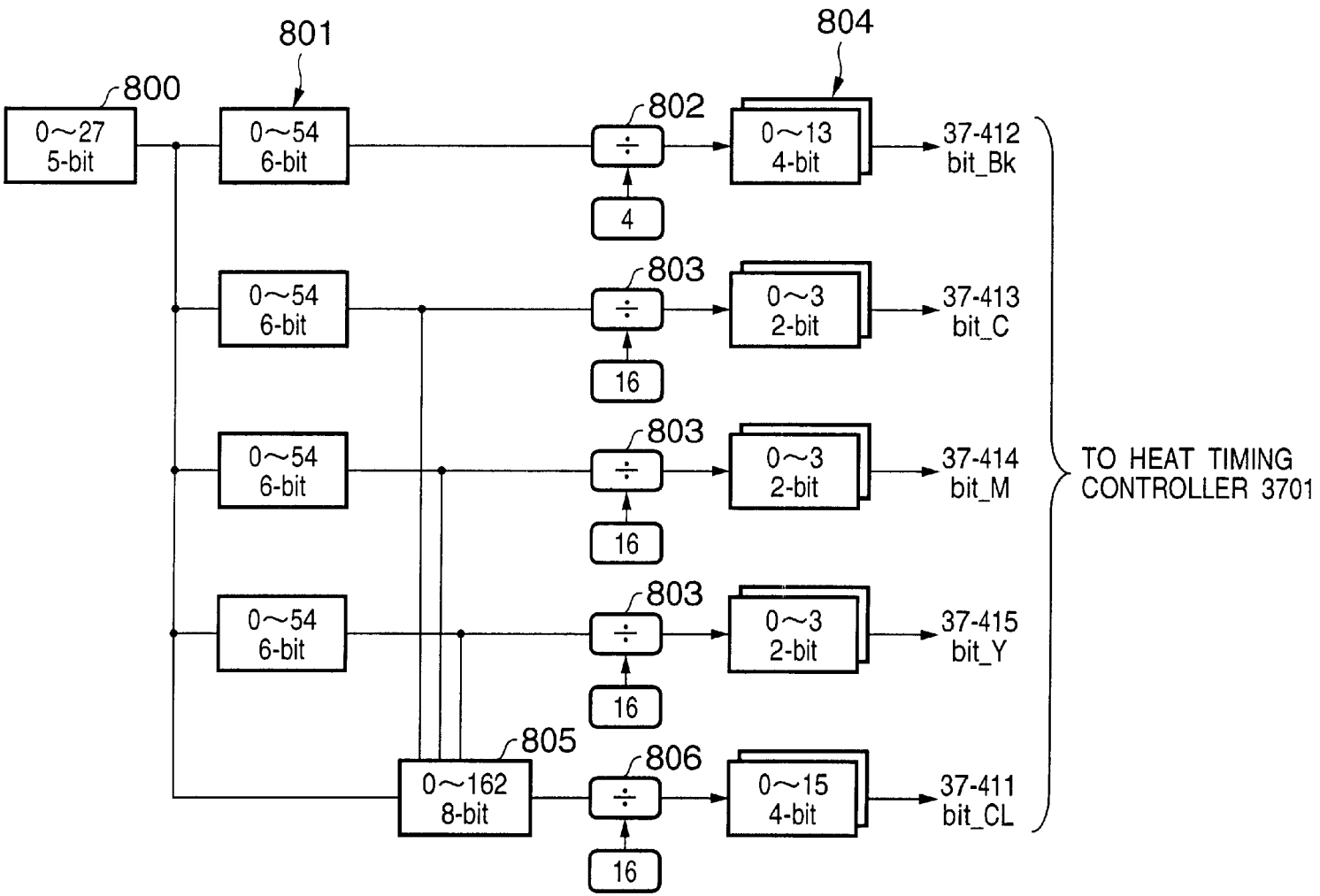
FIG. 9 is a schematic diagram showing a functional composition of a block counter according to the first embodiment of the present invention.

FIG. 9 is a schematic diagram illustrating a functional composition of a block counter according to the first embodiment of the present invention.

When the block counter 3720 reads image data from the RAM 33-2, in a step 800 it first counts to a maximum of 27 dots per ODD and EVEN row each, and counts how many dots of data to be recorded exist per block (that is, per 54 nozzles) in a step 801. Every 6-bit value counted up in this way is divided by 4 in the case of the black recording head 2-1 (in a step 802) and is divided by 16 in the case of the color recording heads 2-2, 2-3 and 2-4 (in a step 803). The black-ink count value is held as 4-bit data and each of the color-ink count values is held as 2-bit data in portions of three colors in a step 804. Further, the three-color portion comprising a 6-bit data count value is then summed and integrated to an 8-bit value in a step 805, divided by 16 in a step 806, rounded and then retained as a 4-bit value in a step 807.

As described above, data that indicates the level of ink discharge to be carried out simultaneously is output to the heat timing controller 3701. This data consists of a total of five different data types, that is, data 37-412 through 37-415 indicating the level of ink to be discharged simultaneously at the black recording head 2-1 and the color recording heads 2-2, 2-3 and 2-4, respectively, as well as data 37-411 indicating the level of ink to be discharged simultaneously for the three colors total.

It should be noted that, although in the first embodiment as described above, the column count values and block count values obtained by division use rounded values, the present invention is not limited to such rounded values. Instead, it is acceptable to use the count values obtained by division as they are, that is, without rounding. Alternatively, the count values may be rounded to an arbitrary number of bits in accordance with the data processing load and an allowable tolerance range level dictated by the actual extent of the effect imparted by the structure of the recording heads.

A description will now be given of control of the heat pulsewidth, with reference to FIGS. 10 and 11.

Figure 10:
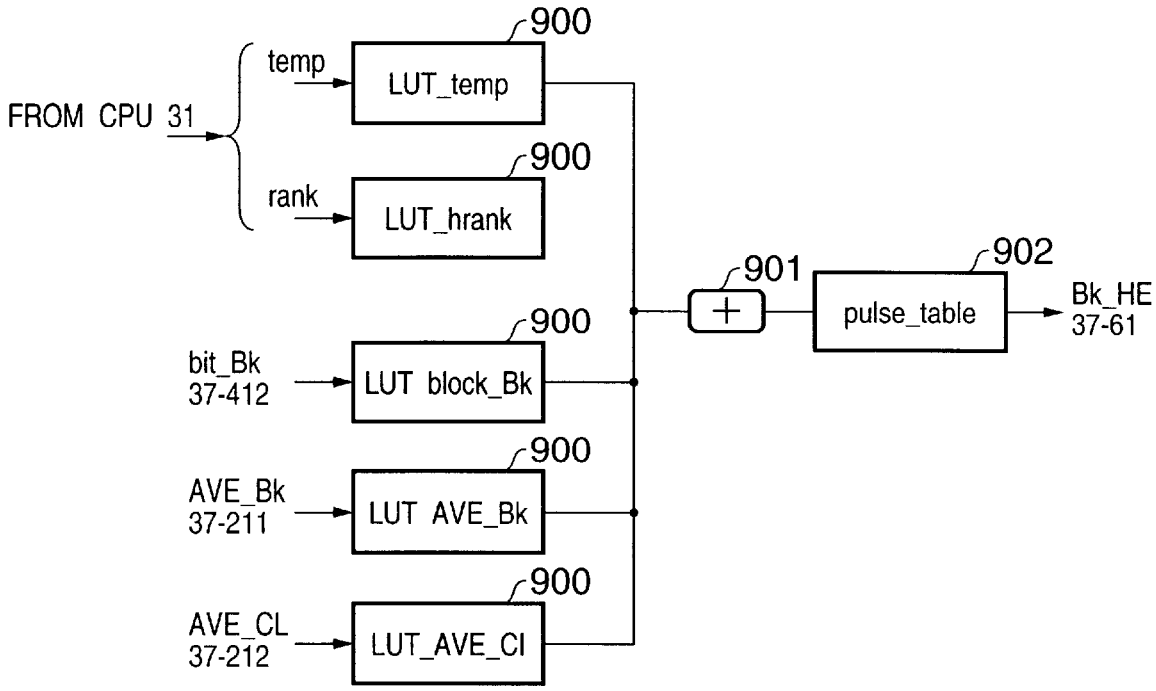
FIG. 10 is a functional block diagram showing a functional composition of a circuit that determines a heat pulsewidth of the black recording head Bk, in a heat timing controller according to the first embodiment of the present invention.

FIG. 10 is a functional block diagram showing a functional composition of a circuit that determines a heat pulsewidth of a black recording head Bk, in a heat timing controller according to the first embodiment of the present invention. FIG. 11 is a functional block diagram showing a functional composition of a circuit that determines a heat pulsewidth of color recording heads, in a heat timing controller according to the first embodiment of the present invention.

As shown in FIG. 10, in addition to the count values (37-211, 37-212, 37-412) from the above-described column counter 3711 as well as block counter 3720, temperature information (temp), which is obtained by using an A/D converter (not shown in the diagram) of the CPU 31 to read changes in the output voltage Vf of temperature sensor diodes mounted on the recording heads but not shown in the diagrams, as well as head ranking information (rank), which is determined by slight differences between the recording heads in terms of heat element resistance, drive transistor ON resistance and so forth as written to EEPROMs (see FIG. 13) mounted on each recording head and as read by the CPU 31, are converted into numerical values and imparted to the heat timing controller 3701.

To the above-described temperature information and ranking information, an adder 901 adds values that are obtained by referencing individual look-up tables (LUT) corresponding to the temperature information and the ranking information. Using the sum obtained by adding the LUT values to the temperature and ranking information as described above and by further referencing a pulse table 902, ultimately, a pulsewidth (Bk Heat enable: 37-61) of a heat pulse Bk_HE to be applied to the black recording head 2-1 is determined.

Figure 11:
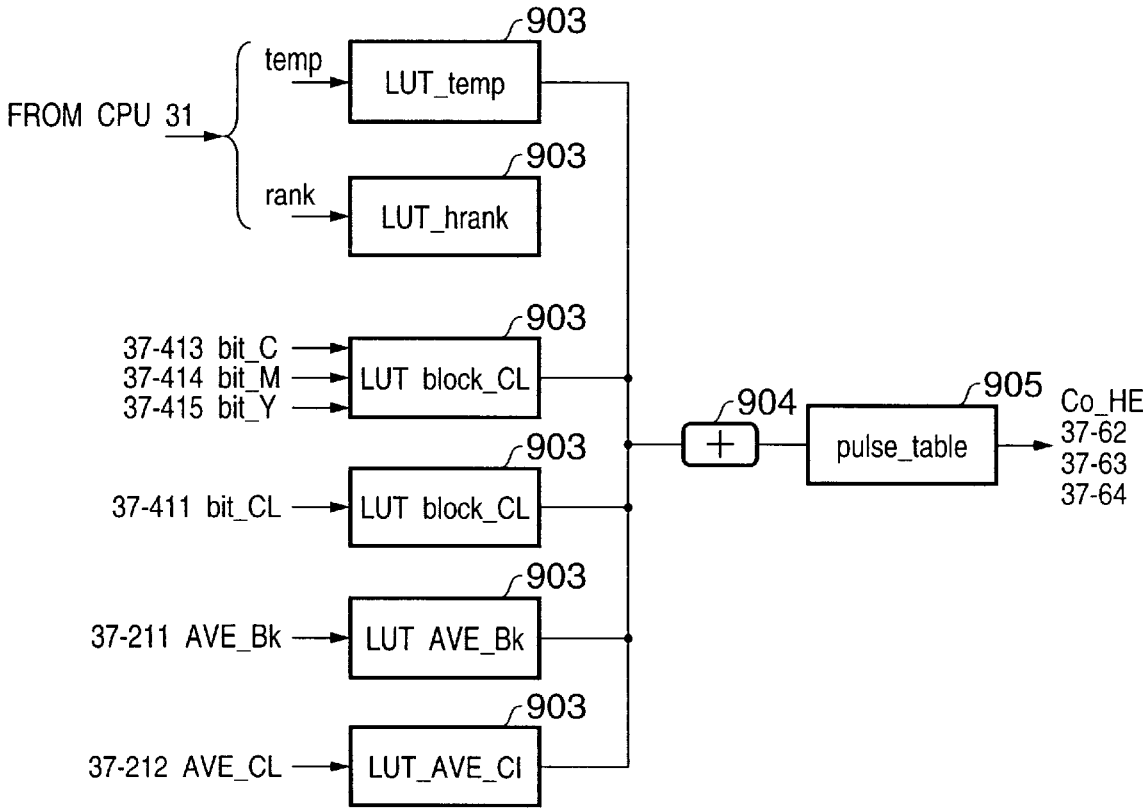
FIG. 11 is a functional block diagram showing a functional composition of a circuit that determines a heat pulsewidth of the color recording head, in a heat timing controller according to the first embodiment of the present invention.

Similarly, in FIG. 11, in addition to the count values (37-211, 37-212, 37-411, 37-413, 37-414, 37-415) from the above-described column counters 3711, as well as block counter 3720, temperature information (temp), which is obtained by using the A/D converter of the CPU 31 to read changes in the output voltage Vf of temperature sensor diodes mounted on the recording heads but not shown in the diagrams, and head ranking information (rank), which is determined by slight differences between the recording heads in terms of heat element resistance, drive transistor ON resistance and so forth as written to EEPROMs (See FIG. 13) mounted on each recording head and as read by the CPU 31, are converted into numerical values and imparted to the heat timing controller 3701.

To the above-described temperature information and ranking information, an adder 904 adds values that are obtained by referencing individual look-up tables (LUT) corresponding to the temperature information and the ranking information. Using the sum obtained by adding the LUT values to the temperature and ranking information as described above and by further referencing a pulse table 905, ultimately, pulsewidths (C Heat enable 37-62, M Heat enable 37-63, Y Heat enable 37-64,) of the heat pulses $C_O$_HE to be applied to the color recording heads 2-2, 2-3 and 2-4 is determined.

It should be noted that the values of the look-up tables 900, 902, 903 and 905 can be set arbitrarily from the CPU 31 and the weighting of the factors can be changed as well, for ease of usage.

By determining the heat pulsewidths of the recording heads based on the number of nozzles to be heated at the same time (in block units) and the counted number of pieces of data per column (nozzle row) to be recorded as described above, it becomes possible to determine the amount of energy to be supplied to each recording head so as to reflect the state of ink discharge of the other recording heads even when the determination of the number of nozzles to be driven simultaneously is complicated by such factors as differences in resolution and so forth.

According to the first embodiment as described above, it is possible to obtain uniform drive conditions without regard to the recording density of each recording head, and thus it is possible to obtain more detailed recordings.

A description will now be given of a process by which the pulsewidth of the drive pulse is determined, with reference to FIG. 12.

Figure 12:
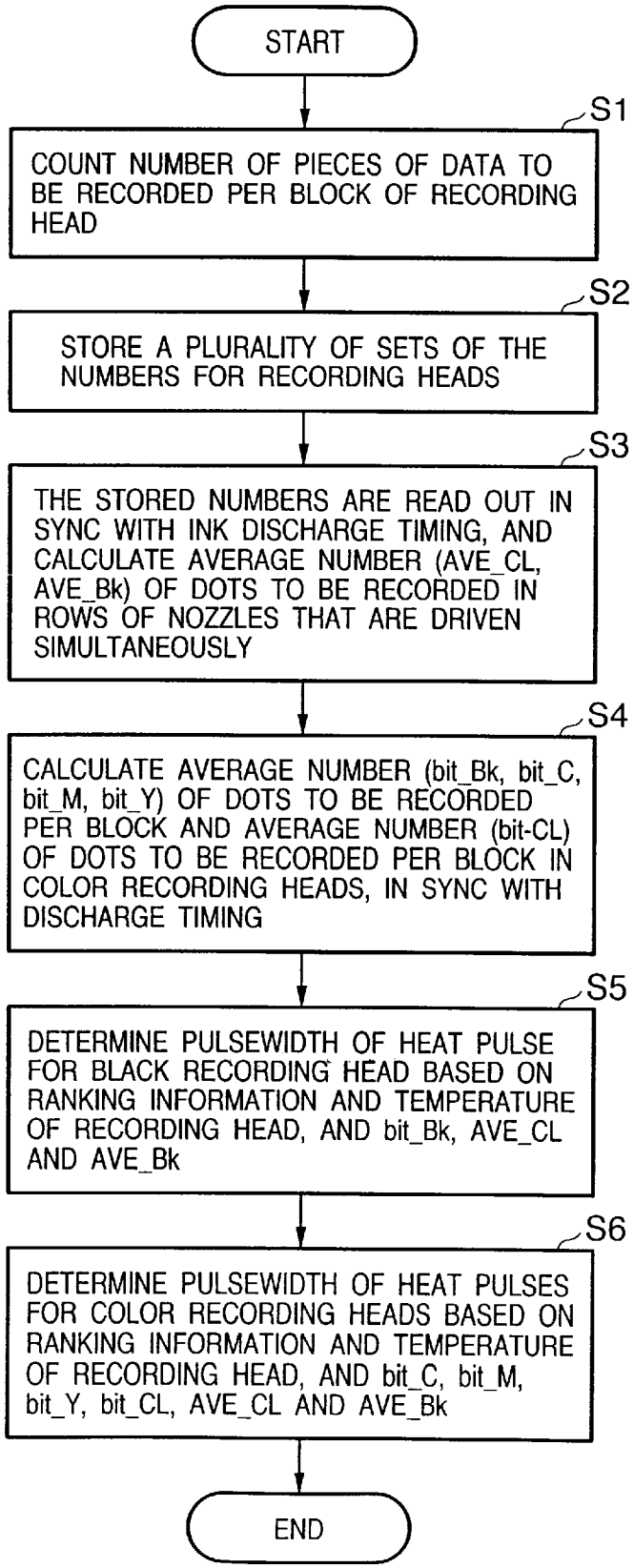
FIG. 12 is a flow chart showing a process that determines a heat pulsewidth of a recording head according to the embodiment of the present invention.

FIG. 12 is a flow chart showing a process that determines a drive pulsewidth of recording heads according to the heat timing controller 3701, the RAM write circuit 3703 and the RAM read circuit 3704 according to the first embodiment of the present invention.

Initially, in step S1, the number of pieces of data per block of the recording heads 2-1, 2-2, 2-3 and 2-4 is counted and the resulting count is divided by a constant as necessary. The result is stored in the RAM 33-2 as a plurality of data pieces (five sets in the embodiment) corresponding to the nozzle rows (eight total) of the four recording heads in a step S2.

Next, the ink discharge timing is set in a step S3 by reading the number of pieces of recording data stored in memory and obtaining the average number of recording dots per row of nozzles for those recording heads that are to be driven at the same time (AVE_CL, AVE_Bk). The process then proceeds to a step S4, in which the total average value of the three color recording heads 2-2, 2-3 and 2-4 (bit_CL) and the average number of pieces of data to be recorded simultaneously (bit_Bk, bit_C, bit_M, bit_Y) for each block of the recording heads in accordance with the recording head discharge timing are obtained. It should be noted that the averages bit_C, bit_M and bit_Y are data that indicates the level of ink discharge to be carried out simultaneously at the recording heads, and that bit_CL is data that indicates the level of ink discharge to be carried out among the color recording heads.

The process then proceeds to a step S5, which determines the pulsewidth of the pulse that drives the black recording head 2-1 based on the ranking information stored in the EEPROM and the temperature sensor of the recording head 2-1 and the values for bit_Bk, AVE_CL and AVE_Bk. Next, in a step S6, the pulsewidth of the pulse that drives the color recording heads 2-2, 2-3 and 2-4 is determined, based on the ranking information stored in the EEPROMs and the temperature sensors of the recording head 2-2, 2-3 and 2-4 and the values for bit_C, bit_M, bit_Y, bit_CL, AVE_CL and AVE_Bk. It should be noted that the order in which the above-described steps S5 and S6 are carried out may be reversed, or steps S5 and S6 may be carried out simultaneously.

Second Embodiment

A description will now be given of a second embodiment of the present invention, with reference to the accompanying drawings.

In the first embodiment described above, when heads of different resolutions are driven by electric power from the same power line, the heat conditions for any given recording head are made to reflect the number of dots in a column that are to be recorded at other recording heads in order to reduce the effects these heads exert on each other. Thus, for example, in the first embodiment described above, the value obtained from the column counts for the color recording heads 2-2, 2-3 and 2-4 is reflected in the process of determining the length of the heat pulse for the black recording head 2-1. Conversely, the column count for the black recording head 2-1 is reflected in the determination of the pulsewidth of the heat pulse for the color recording heads 2-2, 2-3 and 2-4.

By contrast, in the second embodiment described below, the black recording head and the color recording heads all have the same construction, and the drive condition of any one recording head is made to reflect the drive conditions of all the other recording heads.

Figure 13:
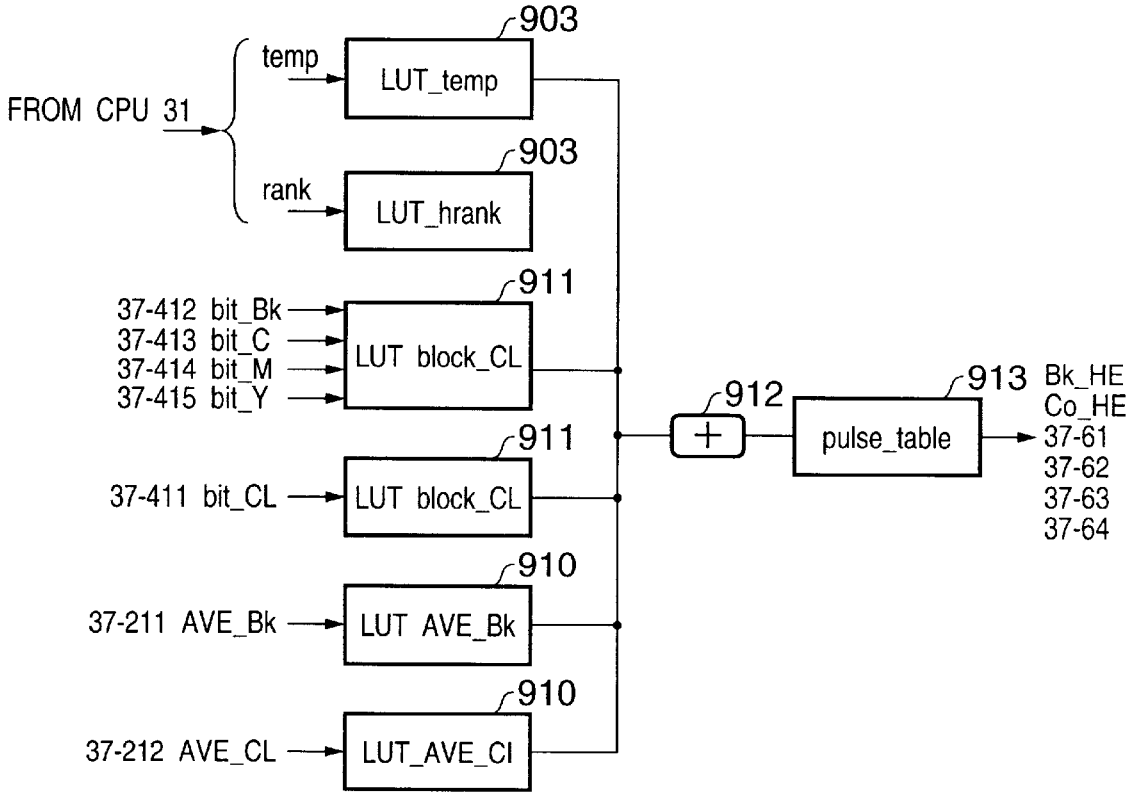
FIG. 13 is a functional block diagram showing a functional composition of a heat timing controller according to a second embodiment of the present invention.

FIG. 13 is a diagram that combines FIGS. 10 and 11, respectively, of the first embodiment described above. It should be noted that, since the recording heads all have the same composition, the pulsewidth of the heat pulse for any one recording head is determined by the number of dots to be recorded in a block of that recording head and the overall column count value.

It should be noted that, although the column counter 3711 depicted in FIG. 8 outputs the count average AVE_CL 37-212 for the six rows of nozzles of the three color recording heads 2-2, 2-3 and 2-4 and the count average AVE_Bk 37-211 for the two rows of nozzles of the black recording head 2-1 separately in the first embodiment of the present invention as described above, in the second embodiment of the present invention as described below the adder 707 and the data 708 have been excluded and a total count value for all eight of the nozzle rows of the four recording heads (black and color) 2-1, 2-2, 2-3 and 2-4 has been calculated and the average column number signal (AVE_CL 37-212) is output. This average column number signal AVE_CL 37-212 is input into the look-up table 910, signals 37-413 through 37-415 are added and the data bit_Bk 37-412 that indicates the level of the count value of the block counter for the black data is input into another look-up table 911. That there is no longer a need for a table to input the black-ink average column count value AVE_Bk 37-211 is the difference between the configuration shown in FIG. 13 and the configuration shown in FIG. 11. It should be noted that although table 910 is shown in FIG. 13, "0" is stored here in this table 910 that inputs the average column count value 37-211.

That the pulsewidth of the heat pulses for the recording heads is determined by adding the output data of the look-up tables by an adder 912 and referencing table 913 is a point that remains the same as with FIGS. 10 and 11 described above.

Accordingly, when a plurality of identically configured recording heads is used simultaneously as described above, the circuit configuration can be simplified by using the block count and the column count of the plurality of recording heads together.

The processing in such a case does not require the average value AVE_Bk obtained in step S3 of the process depicted in the flow chart of FIG. 12 and does not need step S5 shown therein, and can instead be carried out by determining in step S6 the pulsewidth of the pulse that drives each of the recording heads 2-1, 2-2, 2-3 and 2-4 using the ranking information stored in the EEPROM and the temperature sensor of the recording head 2 as well as the values bit_Bk, bit_C, bit_M, bit_Y, bit_CL, AVE_CL and AVE_Bk.

According to the second embodiment of the present invention described above, when using a plurality of identically configured recording heads simultaneously, it is possible to control the supply of power to the recording heads and the heat pulse of the individual recording heads using the same circuit configuration as that of the first embodiment described above.

It should be noted that although the present embodiment is described with reference to the presence of a plurality of recording heads that discharge ink of different colors, the present invention is not limited to such a configuration but should be understood to accommodate, for example, the use of a single recording head employing rows of nozzles corresponding to a plurality of colors, or a plurality of recording heads that discharge ink of the same color.

According to the embodiment described above, the drive state of the recording head is adjusted depending on the drive state of the plurality of discharge ports (that is, nozzles) to improve the ink discharge properties, making it possible to record images of higher quality. Additionally, in an ink jet recording head provided with a plurality of recording heads aligned in a direction parallel to the scanning direction of the head carriage, the drive states of the individual recording heads are adjusted according to the drive states of the plurality of nozzles on each recording head, making it possible to record images of higher quality.

A description will now be given of a third embodiment of the present invention, with reference to the accompanying drawings.

Third Embodiment

Figure 14:
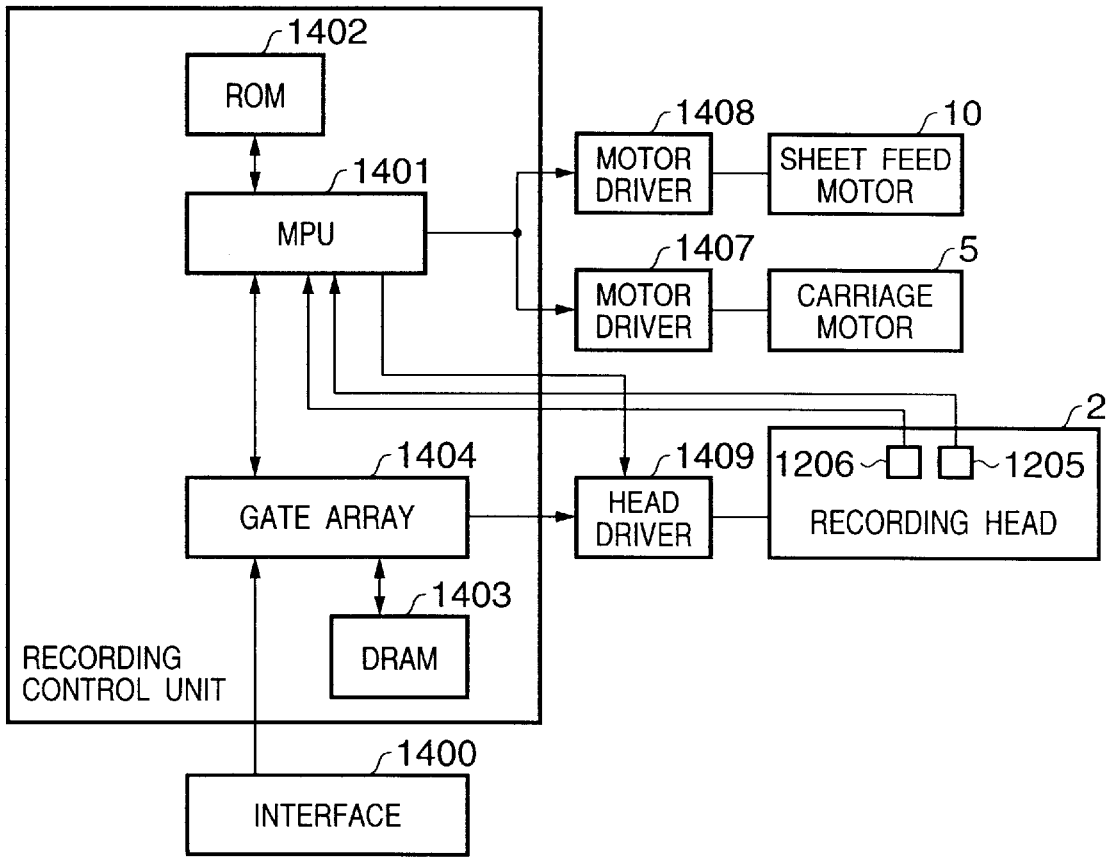
FIG. 14 is a block diagram showing a composition of a control circuit for controlling individual parts of the ink jet recording apparatus according to a third embodiment of the present invention.

FIG. 14 is a block diagram showing the construction of a control circuit that controls the individual parts of an ink jet recording head according to a third embodiment of the present invention. It should be noted that the construction of the ink jet recording head according to the third embodiment to the present invention is substantially identical to the preceding embodiments, and accordingly, the same parts are given the same reference number and a description thereof is omitted.

In FIG. 14, reference number 1400 indicates an interface that inputs recording signals from the host unit, 1401 is an MPU; numeral 1402 denotes a ROM that contains programs that the MPU 1401 executes, and numeral 1403 denotes a DRAM that retains a variety of data (such as the aforementioned recording signal, recording data supplied to the recording head 2) and which is also capable of storing the number of dots to be recorded, the number of times the ink jet recording head 2 has been exchanged, and so forth. Numeral 1404 denotes a gate array that controls the supply of recording data to the recording head 2, and also controls the transfer of data among the interface 1400, the MPU 1401 and the DRAM 1403.

Additionally, reference numeral 5 denotes a carriage motor for transporting the recording head 2, and numeral 10 denotes a sheet feed motor for transporting a recording medium such as a recording sheet. Numerals 1407 and 1408 denote motor drivers that drive the carriage motor 5 and the sheet feed motor 10, respectively. Numeral 1409 denotes a head driver for driving the recording head 2.

Additionally, the recording head 2 is provided with both an EEPROM 1205 that stores data relating to the properties of the recording head itself and a temperature sensor 1206 for measuring the internal temperature of the recording head 2. When the recording head 2 is mounted on the carriage 3, the data stored in the EEPROM 1205 as well as the output from the temperature sensor 1206 can be forwarded to the MPU 1401.

A description will now be given of a method of controlling a recording head having the structure described above, as part of a continuing description of the third embodiment of the present invention.

With respect to a voltage drop through the wiring that supplies electrical power to the recording head, the third embodiment of the present invention independently distinguishes between a voltage drop amount caused by a pulse current and a voltage drop amount caused by a smooth current, accurately ascertains the total voltage drop amount in the drive timing, and drives the recording head with a drive pulse that is appropriate in view of the voltage drop amount.

Concept of Recording Head Control

A description will now be given of the recording head control.

As described previously with reference to FIG. 5, in order to discharge the ink from the nozzles of the recording head, the calculated logical products of the recording data and the heat pulse are input to the recording elements (heating elements) 2-106, causing the recording elements (heating elements) to heat up. The recording data ascertains the presence or absence of recording and the heat pulse contributes to the control of discharge energy. Additionally, the driving of all the nozzles that should be driven at the same time involves a substantial load when viewed in terms of the required energy, generated heat volume and ink supply. Therefore, normally the recording elements (heating elements) are divided into a plurality of blocks, with the blocks being driven at different times.

To begin with, a description will be given of the drive circuit and drive timing of the recording head according to the third embodiment of the present invention, with reference to FIG. 15 and FIG. 16.

Figure 15:
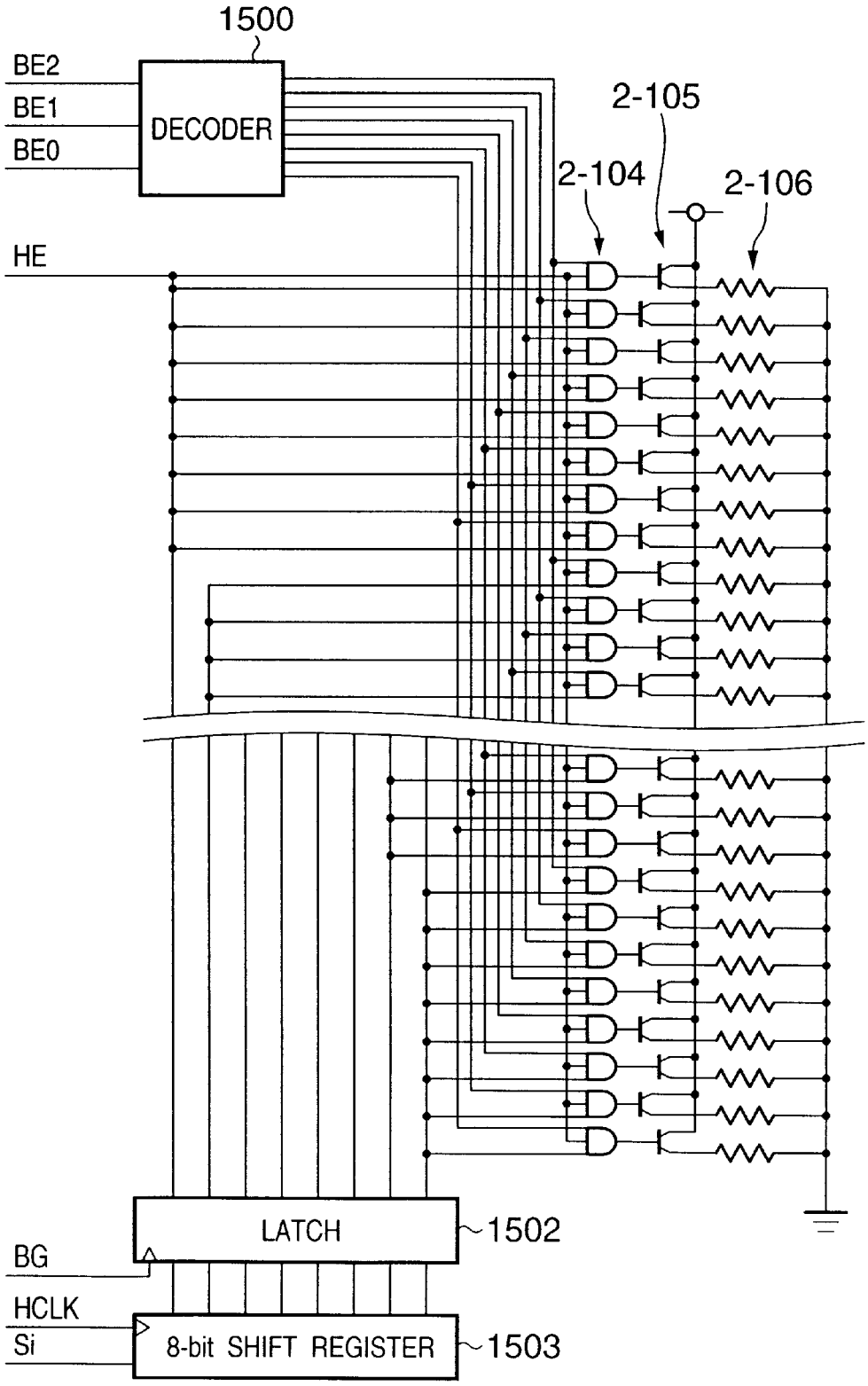
FIG. 15 shows a recording head drive circuit according to the third embodiment of the present invention.

FIG. 15 shows a a drive circuit of the recording head of the third embodiment. FIG. 16 is a timing chart showing drive timing of the recording head depicted in FIG. 15.

As shown in FIG. 15, the recording head 2 has a total of 64 nozzles (recording elements), divided into eight blocks of eight nozzles each by an 8-bit shift resistance 1503 and three block division signals BE0, BE1 and BE2. Each heater 2-106 is driven by a corresponding transistor 2-105, such that, when the heater 2-106 is heated, a bubble forms in the ink inside the nozzle, thus causing the ink to be discharged.

Figure 16:
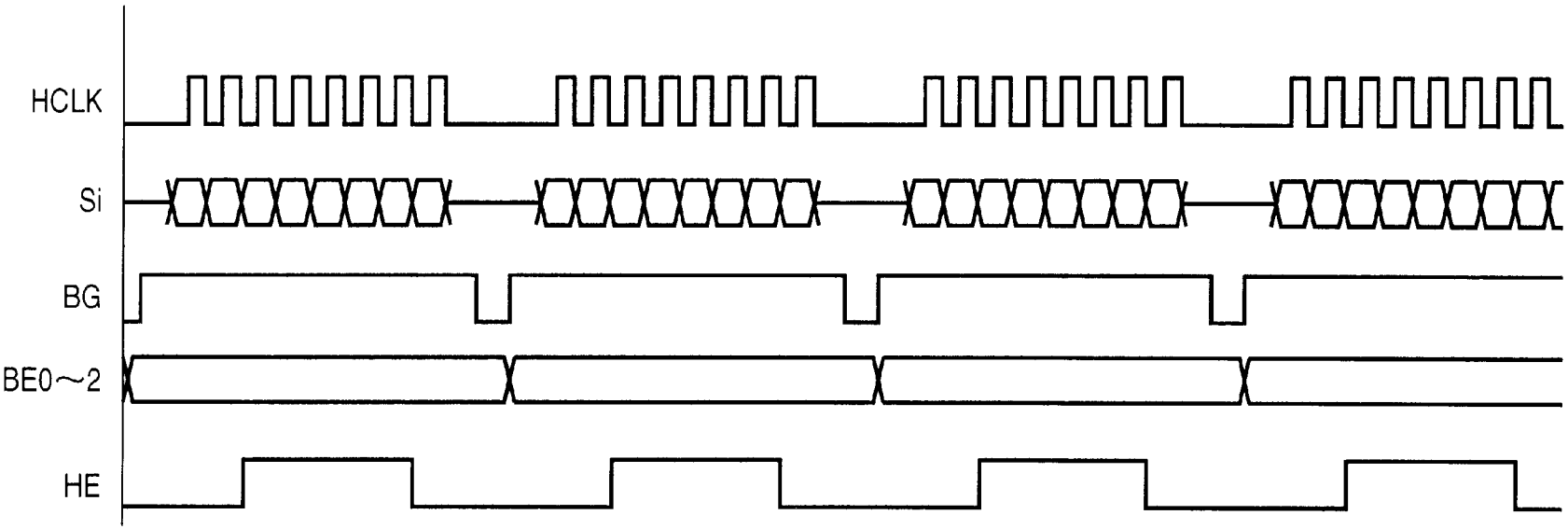
FIG. 16 is a timing chart showing a drive timing of the recording head shown in FIG. 14.

As shown in FIG. 16, the recording data is transferred serially from the head driver 1309 to the shift register 1503 using a clock signal HCLK together with the recording data (Si) and latched by a latch 1502 by a latch signal BG. The block division signals BE0, BE1 and BE2 are decoded into eight signals by a decoder 1500 to become enable signals (block designation signals) for each of the eight blocks into which the heaters 2-106 are divided. Control of the discharge of the ink is carried out according to the logical product of the recording data, the selected block designation signals and the heat pulse signals HE as calculated by the AND circuit 2-104 (that is, the output of the AND circuit 2-104).

In order to further an understanding of the present invention, a description will now be given of the power supply path of an ordinary ink jet recording apparatus, with reference to FIG. 17.

Figure 17:
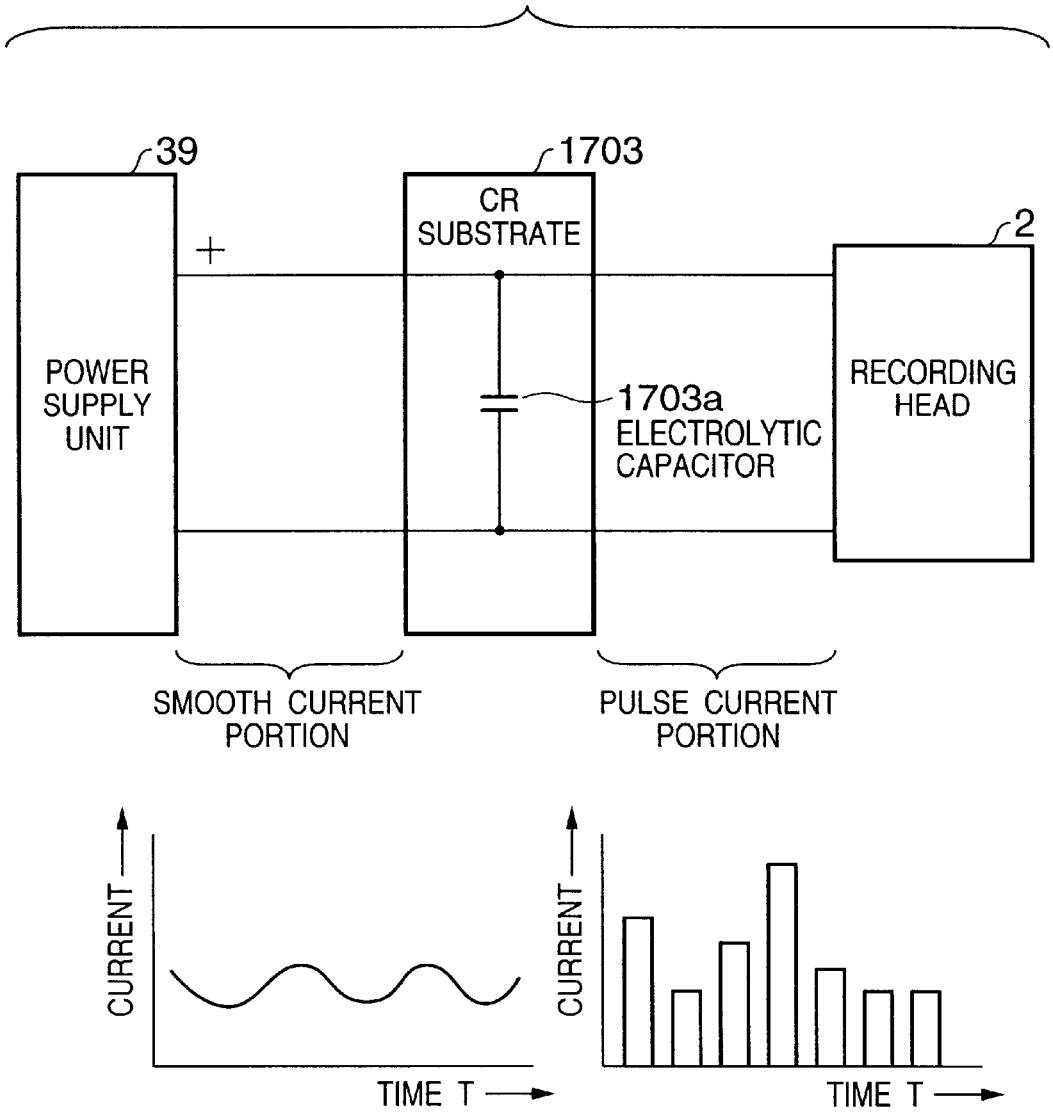
FIG. 17 is a diagram showing a power supply path of an ordinary ink jet recording apparatus.

FIG. 17 is a diagram showing an electric power supply path of an ordinary ink jet recording apparatus.

As shown in the diagram, the drive current for the heaters 2-106, that is, the recording elements (which are not shown in the diagram) of the recording head 2, is supplied to the recording head 2 from an electric power unit of the ink jet recording apparatus main unit. However, as shown in FIG. 17, an electrolytic capacitor 1703*a* is provided on the electric power supply path, so the electrical power that is consumed at any given time by the recording head is augmented by the electric charge stored in the capacitor 1703*a*. Accordingly, according to the recording operation, changes over time in the current that passes through the power supply path in order to drive the heaters, when considered closely, can be seen to differ between the power supply unit (that is, the recording apparatus side), on the one hand, and the recording head side on the other, a difference due to and appearing from a point at which is located a CR substrate 1703 that is provided with the electrolytic capacitor 1703*a*.

More specifically, although in that part of the electric power supply path that lies between the CR substrate 1703 and the recording head 2 the drive current fluctuates relatively substantially depending on the number of heaters to be driven simultaneously at any given time, in that part of the electric power supply path that lies between the recording apparatus and the CR substrate 1703 the electric power so supplied is augmented by the electrolytic capacitor 1703*a* so that any change over time in the current is relatively small and the current appears smooth. For this reason, in the electric power supply path, that part of the heater drive current between the CR substrate 1703 and the recording head 2 is called a pulse current portion and that part between the CR substrate 1703 and the recording head is called a smooth current portion.

To continue, the current that drives the recording head 2 is attenuated by the resistance of the wiring of the electric power supply path itself and a drop in voltage is generated. Strictly speaking, however, this voltage drop can be divided between that which is contributed by the pulse current portion and that which is contributed by the smooth current portion.

Accordingly, in the third embodiment of the present invention, the evaluation of the voltage drop is divided into a portion contributed by the pulse current portion and a portion contributed by the smooth current portion.

Figure 18:
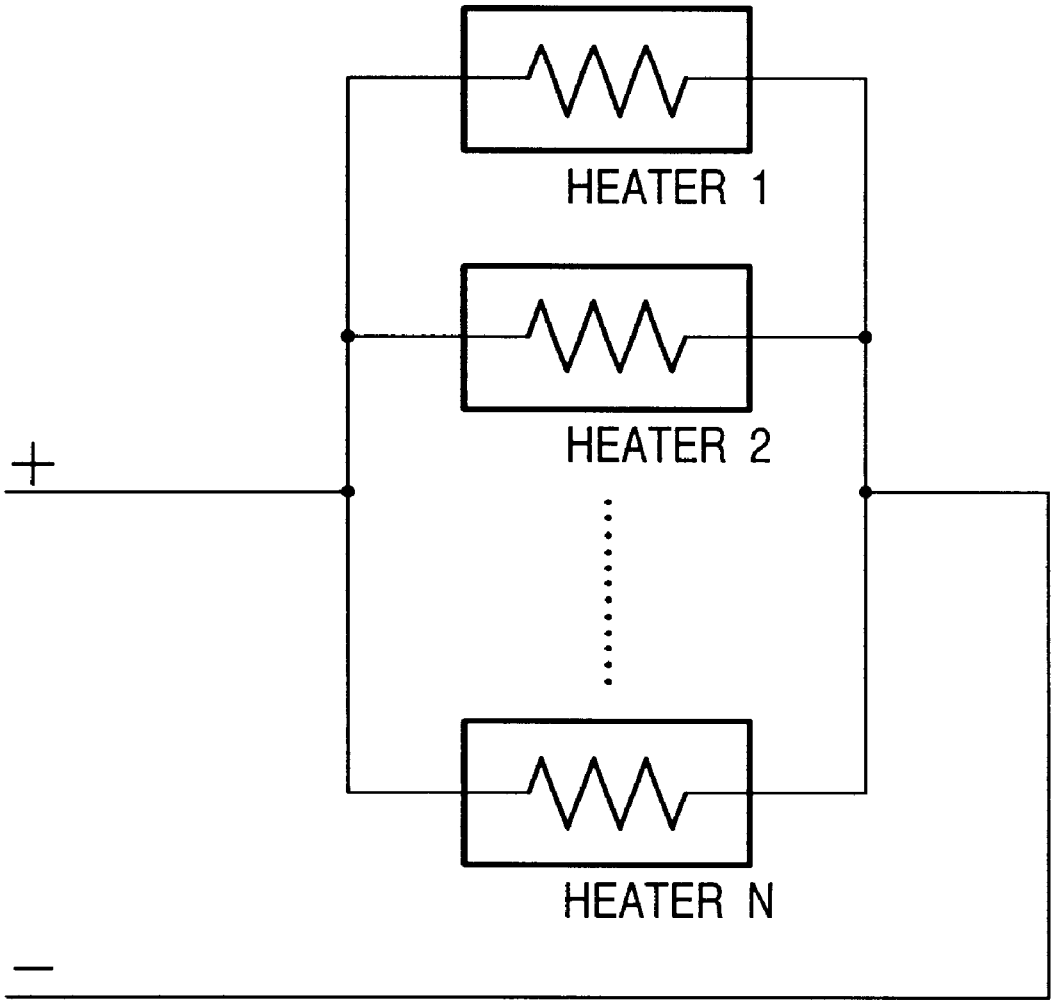
FIG. 18 shows an equivalent circuit of a power circuit when "N" number of nozzles operate simultaneously.

FIG. 18 shows an equivalent circuit of a power supply circuit when "N" number of nozzles are driven simultaneously.

When a voltage drop occurs, in order to supply the same amount of energy to all the heaters (recording elements) 2-106 of the recording head 2, it is necessary to lengthen the pulsewidth in order to compensate for the drop in voltage. Assuming that the recording apparatus is one that mounts one or more recording heads having one chip (that is, one head substrate), comprising 64 nozzles_4 colors, the recording head(s) being driven off a single electric power supply system, and the 64 nozzles of the chip being divided into eight blocks that are driven independently, then the number of nozzles that are driven simultaneously at any given time is 0–32, a figure arrived at by noting that the number of nozzles to be simultaneously driven is 8 nozzles per chip_4 chips. If, moreover, the number of nozzles to be driven simultaneously at any given time is uniform in space as well as uniform in time with respect to the nozzle position of each chip, then when the number of nozzles to be driven simultaneously is "N", the electric power supply circuit can be though of as a parallel circuit consisting of N numbers of heaters 1-N connected in parallel as shown in FIG. 18.

At this time, although the wiring resistance with respect to the heaters 1-N in the recording head 2 changes depending on the distance from the recording head 2 electrode to the individual heater, in order to prevent such fluctuations it is preferable to adjust the wiring resistance within the recording heads by for example changing the thickness of the wiring, so that the wiring resistance becomes the same for all heaters.

Figure 19:
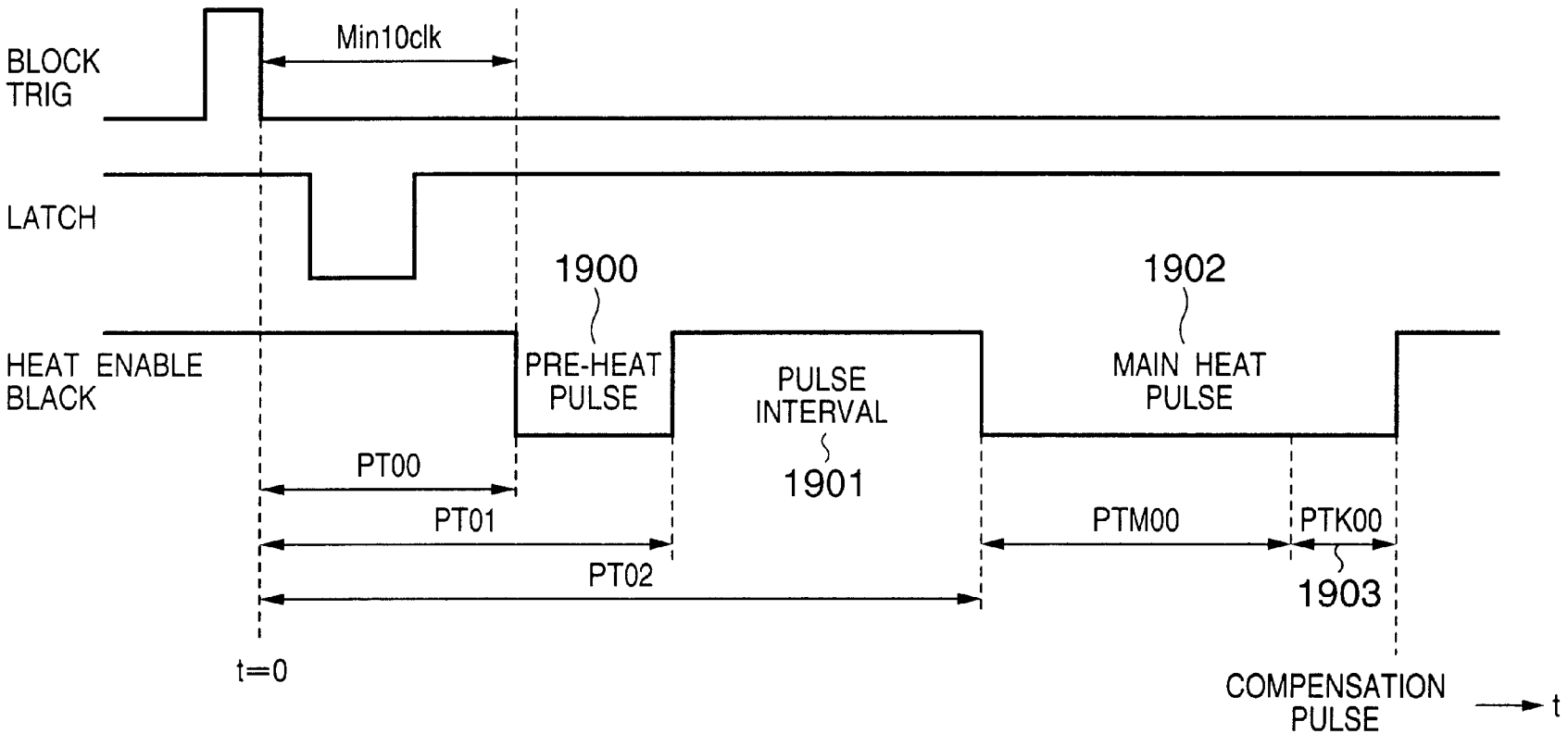
FIG. 19 is a diagram showing a composition of a heat pulse used in the third embodiment of the present invention.

FIG. 19 is a diagram showing a composition of a heat pulse used in the third embodiment. In FIG. 19, the heat enable signal "Heat Enable" is shown as a negative logic.

In the third embodiment, the heat enable signal is a double-pulse construction involving a preheat pulse 1900, a pulse interval 1901 and a main heat pulse 1902. It should be noted that, in a case in which the volume of ink discharged or the speed of discharge do not change depending on the construction of the nozzles of the recording head 2 and the physical properties of the ink, the heat enable signal may be a single-pulse construction comprising the main pulse alone.

As shown in FIG. 19, a time interval PT00 is a pulse margin of approximately 0.1 $\mu$s from the end of a block trigger signal ("Trig") for carrying out a proper latch. The interval t=PT00–PT01 is an interval in which electric power is supplied to the heaters by the preheat pulse 1900. The interval t=PT01–PT02 is a rest interval (that is, a pulse interval) 1901. Thereafter, the time interval PTM00 main heat pulse 1902 is applied and ink is discharged. It is preferable that, depending on such conditions as the resistance of the heaters 2-106 of the recording head, the ON resistance of the transistor 2-104 and so forth, the lengths of the preheat pulse 1900, the pulse interval 1901 and the main heat pulse 1902 be adjusted to optimize ink discharge volume, discharge speed and so forth.

It should be noted that the interval PTK00 indicated by reference numeral 1903 is a pulse for the purpose of compensating for the voltage drop that occurs as the number of heaters to be driven simultaneously increases.

Figure 20:
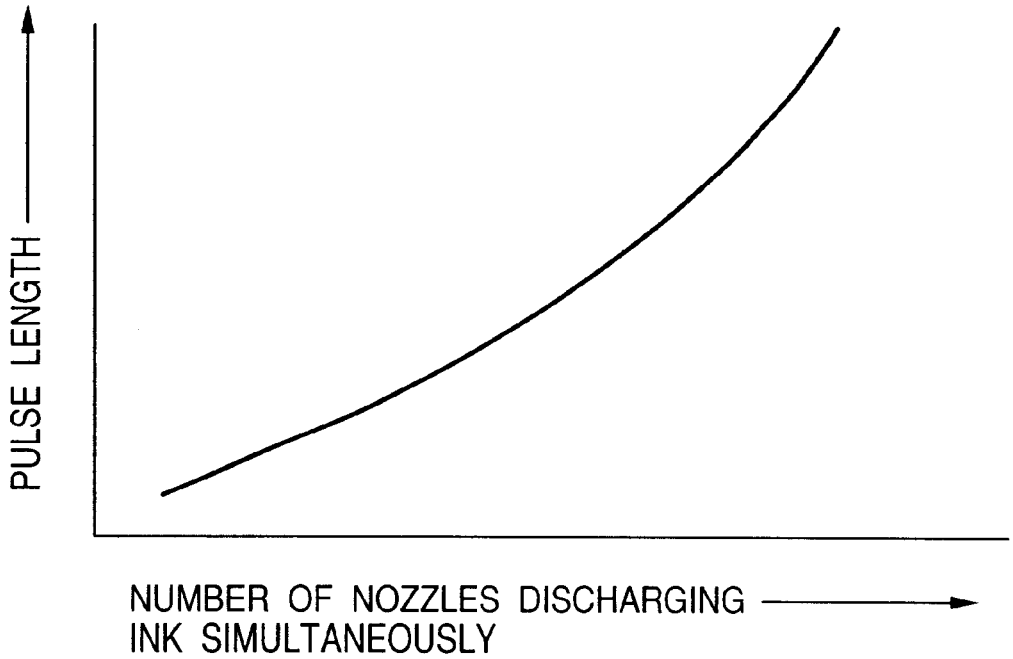
FIG. 20 is a diagram showing a relation between number of simultaneous discharges and drive pulse.

When the voltage drop that occurs with the simultaneous drive discharge of a plurality of recording elements is compensated for by the drive pulsewidth (the main heat pulsewidth), the relation between the number of nozzles driven simultaneously and the drive pulse is as depicted in FIG. 20.

That is, in FIG. 20, as the number of nozzles to be driven simultaneously increases, the length of the drive pulse that compensates for the voltage drop that arises also increases. FIG. 20 is a diagram showing a relation between number of simultaneous discharges and drive pulse.

A detailed description will now be given of the compensation for the voltage drop, with reference to FIG. 21.

Figure 21:
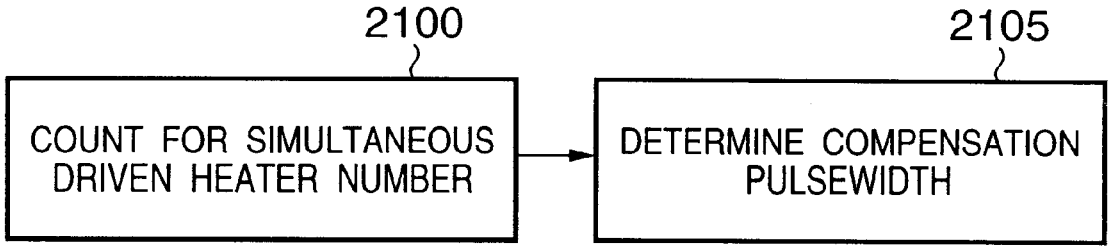
FIG. 21 is a block diagram for illustrating a conventional voltage drop compensation process using a heat pulse.

FIG. 21 is a block diagram for illustrating a conventional voltage drop compensation process using a heat pulse.

According to the conventional art, the timing with which the block trigger signal (Trig) is introduced involves counting the number of heaters (recording elements) to be driven simultaneously (step 2100 in FIG. 21) and determining a compensation pulsewidth depending on the count value (step S2105 in FIG. 21).

According to such conventional art, the amount of the voltage drop contributed by the pulse current portion described above can be accurately determined. However, the amount of the voltage drop due to the smooth current portion cannot be ascertained, so the overall amount of the voltage drop cannot be estimated. In other words, in order to maintain the quality of the recording, a state that generates a maximum voltage drop, that is, a state that continuously maintains the maximum number of recording elements to be driven simultaneously, is simply assumed, and a pulse capable of delivering stable ink discharge is created accordingly.

However, with such a pulse setting arrangement as described above, the pulsewidth of drive pulse becomes relatively long. Accordingly, when continuous recording is carried out in a state in which few recording elements are dischargeably driven simultaneously, excess energy is applied to the heaters. The supply of such unnecessary and excessive power to the heaters shortens their working life.

Accordingly, in order to overcome such a drawback, the third embodiment of the present invention estimates the voltage drop more accurately so as to be able to drive the recording elements with a pulsewidth of optimum duration.

Figure 22:
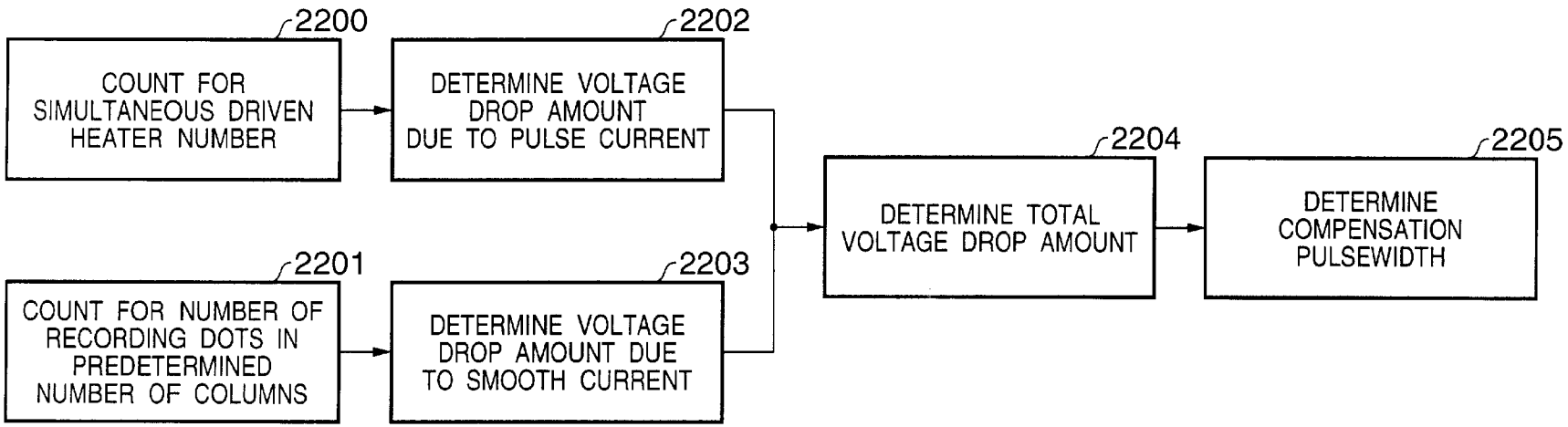
FIG. 22 is a block diagram illustrating a voltage drop compensation process using a heat pulse according to the third embodiment of the present invention.

FIG. 22 is a block diagram illustrating a voltage drop compensation process using a heat pulse according to a third embodiment of the present invention.

As shown in FIG. 22, the timing with which the block trigger signal (Trig) is introduced involves counting the number of heaters to be driven simultaneously (step 2200 in FIG. 22) and determining the amount of the voltage drop in the pulse current portion from the counted value (step 2202 in FIG. 22). At the same time, the number of dots to be recorded for a predetermined number of columns (for example 10 columns) is counted (step 2201 in FIG. 22), and from that count value the amount of the voltage drop in the smooth current portion is determined (step 2203 in FIG. 22).

Next, the total voltage drop amount for the electric power supply wiring system as a whole during block selection is determined from the above-described voltage drop amounts over the pulse current portion and the smooth current portion (step 2204 in FIG. 22), and the length of the pulse to be used for compensation is determined from the total voltage drop amount (step 2205 of FIG. 22).

It should be noted that the columns described herein refer to a recording cycle in which one opportunity to record is given to all of the recording elements of the recording head 2. As noted previously, the recording head 2 is mounted on the carriage 3, so that recording takes place as the carriage moves in the scanning direction, so the column number indicates the number of recording cycles (recording drive times) when recording while the recording head 2 is moving in the scanning direction. The predetermined number of columns of the third embodiment of the present invention described above is determined by the capacity of the electrolytic capacitor described with reference to FIG. 17. That is, the predetermined number of columns is determined by the amount of recording that can be supplemented by the electric power stored in the electrolytic capacitor 1703*a*. It should be noted that, in the third embodiment, the predetermined number is given as "10". However, such number is for illustrative purposes only and it is to be understood that the present invention is not limited to such number. Instead, it is to be understood that such number depends on the properties of the recording head 2 and on the capacity of the electrolytic capacitor, and other numbers (such as, for example, 20, 32, and so forth) may be used as well.

Determination of the amount of the voltage drop and control of the length of the compensation pulse outlined with reference to FIG. 22 is achieved by the type of process to be described below, with reference to FIG. 23 and FIG. 24.

Figure 23:
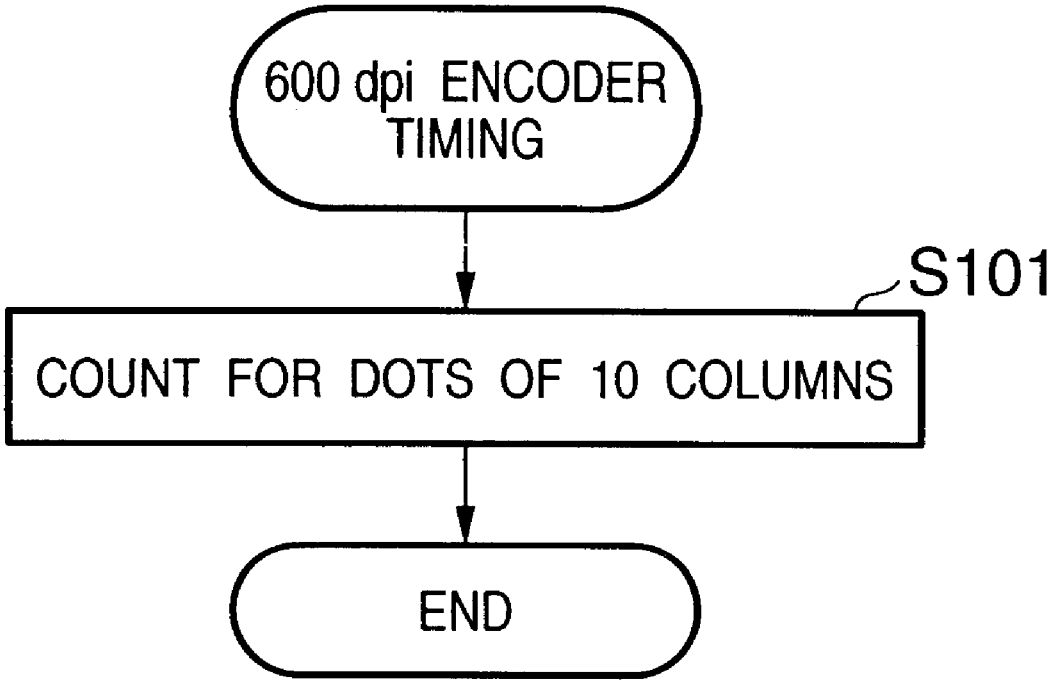
FIG. 23 is a flow chart showing a 600 dpi encoder signal output timing process.

FIG. 23 is a flow chart showing a 600 dpi encoder signal output timing process. FIG. 24 is a flow chart showing a timing process that includes a block trigger signal (Trig).

As shown in FIG. 23, in a 600 dpi resolution encoder timing process, in a step S101 a number of dots to be recorded that is equivalent to 10 columns is counted.

Figure 24:
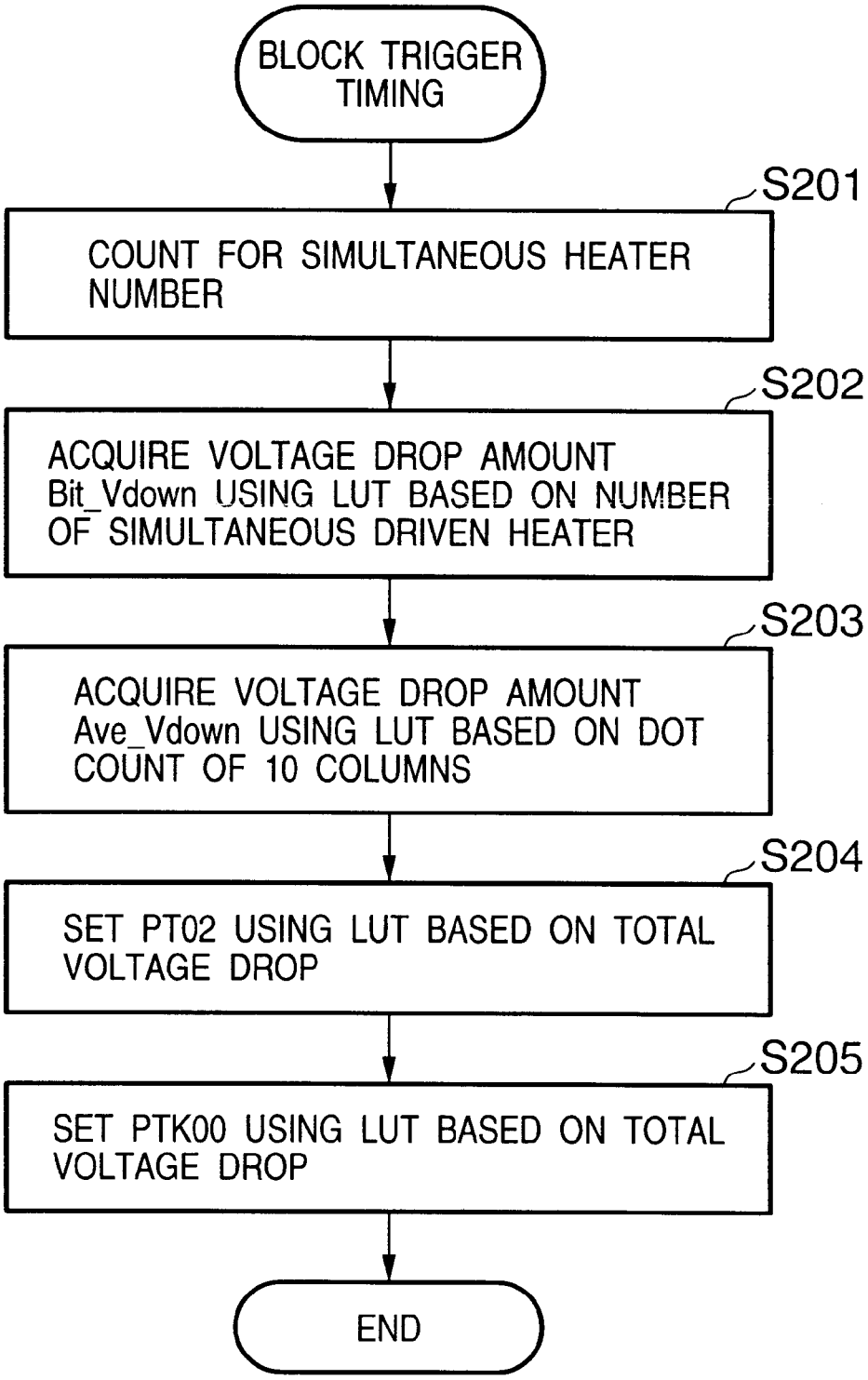
FIG. 24 is a flow chart showing a timing process that includes a block trigger signal (Trig)

As shown in FIG. 24, in a block trigger timing process, initially, the number of recording elements (heaters) to be driven simultaneously is counted in a step S201. Next, based on the counted number of recording elements to be driven simultaneously, the voltage drop amount (Bit_Vdown) across the pulse current portion is acquired from one look-up table (LUT) in a step S202.

To continue, the voltage drop amount (Ave_Vdown) over the smooth current portion is acquired from another LUT in a step S203 based on the counted number of dots in the 10 columns counted ion the 600 dpi resolution encoder timing process. Next, the timing (PT02) of the introduction of the main heat pulse 1902 is determined from a total voltage drop amount (Vdown) obtained by adding the voltage drop amount (Bit_Vdown) across the pulse current portion and the voltage drop amount (Ave_Vdown) over the smooth current portion in a step S204.

Finally, the length (PTK00) of the compensation pulse 1903 is determined from the total voltage drop amount that is the sum of the Bit_Vdown and Ave_Vdown voltage drops in a step S205.

In the block selection timing described above, determining the timing of the output of the main heat pulse 1902 at the same time as determining the length PTK00 of the compensation pulse 1903 is done in order to be able to adjust the amount of ink discharged and the speed of the discharge, which are determined by changes in the length of the compensation pulse 1903, by changing the timing PT02.

A description will now be given of the process by which the basic pulses and tables are given their settings, with reference to FIG. 25.

Figure 25:
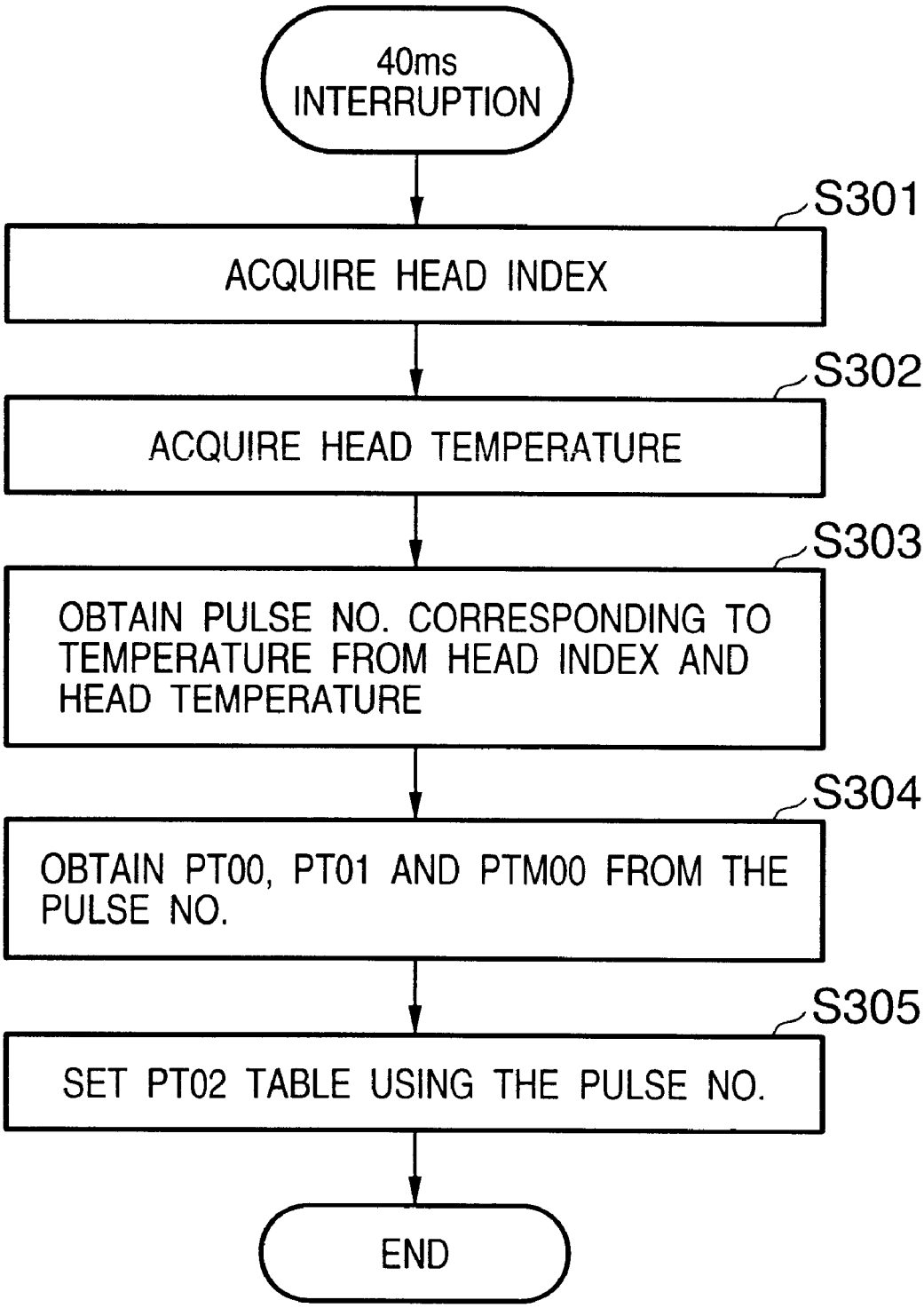
FIG. 25 is a flow chart showing a pulse setting and table setting process in response to a temperature inside the recording head every 40 ms.

FIG. 25 is a flow chart showing a pulse setting and table setting process in response to a temperature inside the recording head every 40 ms.

By changing the pulse state according to the temperature inside the recording head 2, it is possible to stabilize the ink discharge properties such as the amount of ink discharged and the speed with which the ink is discharged.

As indicated in the flow chart depicted in FIG. 25, initially, in a step S301 a head index is acquired from information stored in the EEPROM 1205 built into the recording head 2. The head index is a value that corresponds to the resistance of the recording head 2 heaters 2-106, the ON resistance of the transistors 2-105 that drive the heaters and the wiring resistance. It is preferable that the head index be pre-stored in a non-volatile memory such as an EEPROM in order to drive the recording head with the appropriate pulse. In addition to reading information from the EEPROM built into the recording head 2, however, such information may also be input from the host unit 41 connected to the recording apparatus.

Next, the temperature of the recording head 2 is acquired from the temperature sensor 1206 in a step S302.

The head index and the recording head 2 temperature are key pieces of information used to search the LUT stored in the ROM 1402 (see FIG. 14) provided on the recording apparatus control circuit. The LUT contain information used to determine the pre-heat pulsewidth, the main heat pulsewidth and the pulse interval, keyed to a plurality of temperature ranges and a plurality of head indexes. Accordingly, appropriate pre-heat and main heat pulsewidths and pulse intervals can be selected using the head index and the measured recording head temperature. It should be noted that the LUT comprises the three tables shown in FIGS. 26, 27 and 28.

Figure 26:
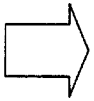
FIG. 26 shows an example of a temperature-linked pulse number table.

FIG. 26 is a diagram showing a temperature-linked pulse number table, the numbers used to determine key numbers that are used to determine a pre-heat pulsewidth and a main heat pulsewidth and a pulse interval based on the recording head 2 temperature and the head index obtained from the information stored in the EEPROM 1205 built into the recording apparatus, in which temperature-keyed pulse numbers corresponding to the head indexes and the head temperature ranges are set.

Figure 27:
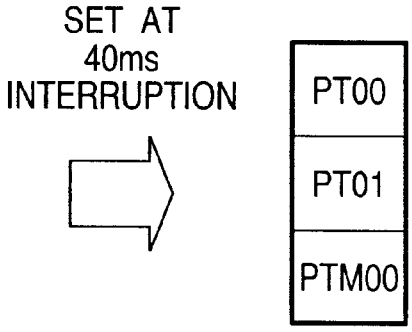
FIG. 27 shows an example of a table defining PT00, PT01, PTM00 corresponding to temperature-linked pulse numbers.

FIG. 27 is a diagram showing a table defining the intervals PT00, PT01 and PTM00 depicted in FIG. 19 and corresponding to the temperature-linked pulse numbers ("No.") obtained by reference to the table depicted in FIG. 26. In FIG. 27, intervals corresponding to PT00, PT01 and PTM00 are set according to each of the temperature-linked pulse numbers 0–43.

Figure 28:
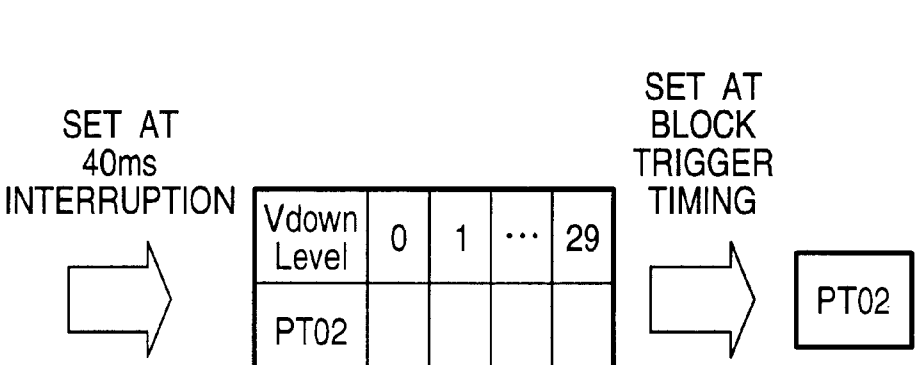
FIG. 28 shows an example of a table defining PT02 according to 30 ranks of voltage drop levels that correspond to temperature pulse numbers.

FIG. 28 is a diagram showing a table defining the output timing PT02 of the main heat pulse according to the temperature-linked pulse numbers "No." obtained from the table depicted in FIG. 26 and to 30 ranks ("Vdown0, Vdown1, . . . Vdown29") of the total voltage drop levels ("Vdown").

Such selections are made as follows.

First, the table shown in FIG. 26 is searched and, based on the head index and recording head 2 temperature, the temperature-linked pulse No. is determined (in step S303 in FIG. 25). Next, using the determined pulse No. as a key, the table shown in FIG. 27 is referenced and the intervals Pt00, PT01 and PTM00 are set (in step S304). Finally, using the temperature-linked pulse No. as a key, the table shown in FIG. 28 is searched and a PT02 consisting of the above-described 30 ranks of total voltage drops "Vdown" is selected and set as the PT02 selection table. The PT02 selection table st is used to determine the PT02 interval in the block trigger signal "Trig" introduction timing.

Thus, the intervals PT00, PT01, PT02 and PTM00 are each determined as described above. However, when the recording head 2 is mounted on the carriage 3, the compensation pulsewidth PTK00 is determined as described below.

Figure 29:
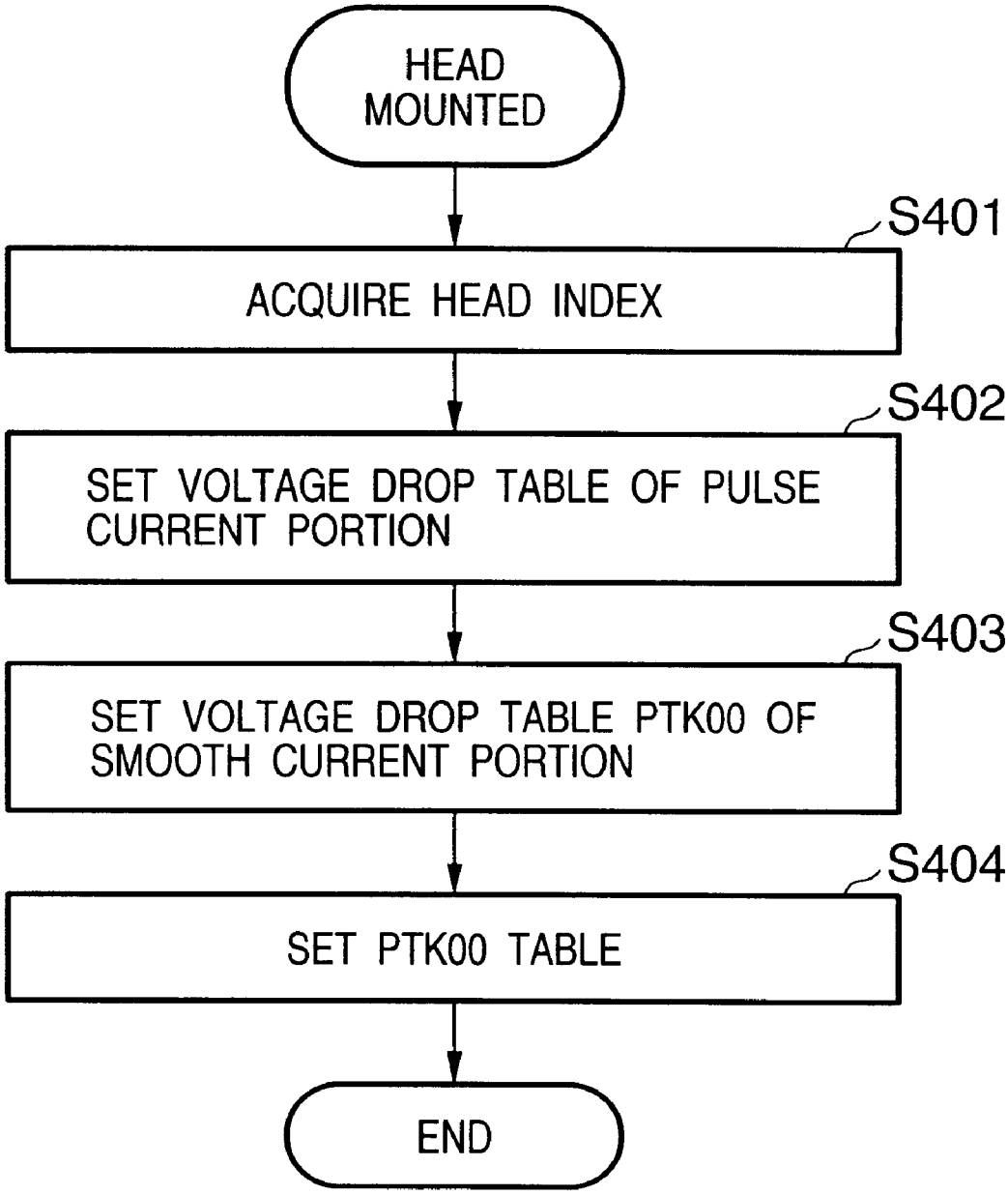
FIG. 29 is a flow chart showing a compensation pulse (PTK00) setting process when installing the recording head.

FIG. 29 is a flow chart showing a compensation pulse (PTK00) setting process when installing the recording head. The process sets the tables used to determine accurately the voltage drop amount and to determine the drive pulse according to the resistance of the recording head 2 heaters (recording elements) 2-106, the ON resistance of the heater drive transistors 2-105 and the wiring resistance.

According to the flow chart shown in FIG. 29, a head index is obtained from the information contained in the EEPROM 1205 built into the recording head 2 in a step S401. The head index is used as key information for searching the LUT stored in the ROM 1302 provided on the control circuit of the recording apparatus. Information for determining the compensation pulsewidth PTK00 corresponding to each of the plurality of head indexes is stored in the LUT. Accordingly, from the head index it is possible to select a compensation pulsewidth (PTK00) appropriate to the recording head 2. It should be noted that the LUT is composed of the three tables shown in FIGS. 30–32.

Figure 32:
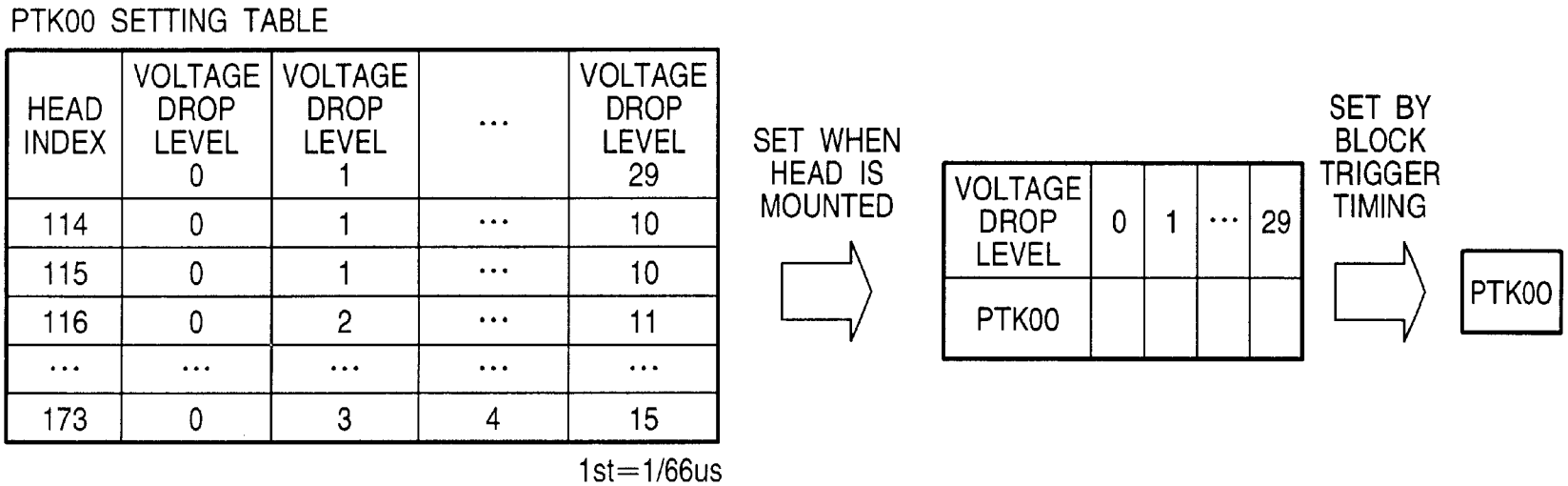
FIG. 32 shows an example of a table defining compensation pulses (PTK00) according to 30 ranks of voltage drop levels corresponding to individual head indexes.

FIG. 30 is a diagram showing a table that defines 14 ranks of voltage drop levels across the pulse current portion corresponding to the head indexes. FIG. 31 is a diagram showing a table that defines 11 ranks of voltage drop levels across the smooth current portion corresponding to the head indexes. FIG. 32 is a diagram showing sample contents of a table that defines the compensation pulsewidth (PTK00) corresponding to 30 ranks of voltage drop levels corresponding to the head indexes. It should be noted that it is desirable that the level numbers of the tables shown in the diagrams should be adjusted to the composition of the recording head and recording apparatus.

The optimum compensation pulsewidth (PTK00) is selected as follows.

Initially, the table shown in FIG. 30 is searched and a Bit_Vdown table used to determine the pulse current portion voltage drop amount according to the head index obtained from the EEPROM 1205 is set (in step S402). Next, the table shown in FIG. 31 is searched and the Ave_Vdown table used to determine the smooth current portion voltage drop amount is set according to the head index obtained from the EEPROM 1205 (in step S403). Finally, the table shown in FIG. 32 is searched and the PTK00 table that corresponds to the head index obtained from the EEPROM 1205 is set.

Thus, the table to be set is determined according to the head index as determined by the individual heater resistances and the like of the individual recording heads. The voltage drop amount is then accurately determined from the tables so determined, based on information that is specific to each recording head.

According to the third embodiment as described above, the voltage drop over the pulse current and the voltage drop amount over the smooth current are determined independently, so the total voltage drop through the drive timing can be determined accurately and, accordingly, the pulse can be controlled as appropriate, depending on the total voltage drop amount, that is, the appropriate pre-heat pulsewidth, main heat pulsewidth, pulse interval and compensation pulsewidth can be determined.

As described above, an appropriate pulse can be applied to each recording head, and accordingly, it is possible to contemplate an improvement in working life of even those recording heads with a large number of recording elements and which are heavily affected by the voltage drop as a result.

Fourth Embodiment

A description will now be given of a fourth embodiment of the present invention, with reference to the accompanying drawings.

The fourth embodiment is described with reference to a recording head having a construction consisting of a plurality of chips (that is, head substrates) and provided with an independent wiring region and a joint wiring region, in which the voltage drop of each of the chips due to the pulse current is determined independently so as to effect appropriate pulse control.

Particular reference is made to a recording head in which a recording element group for discharging ink of four different colors (black, cyan, magenta and yellow) and their associated logic circuits are provided on each chip, with four independent chips provided for the four independent colors.

A detailed description will now be given of the electric power supply path and voltage drop thereof, with reference to the accompanying drawings.

Figure 33:
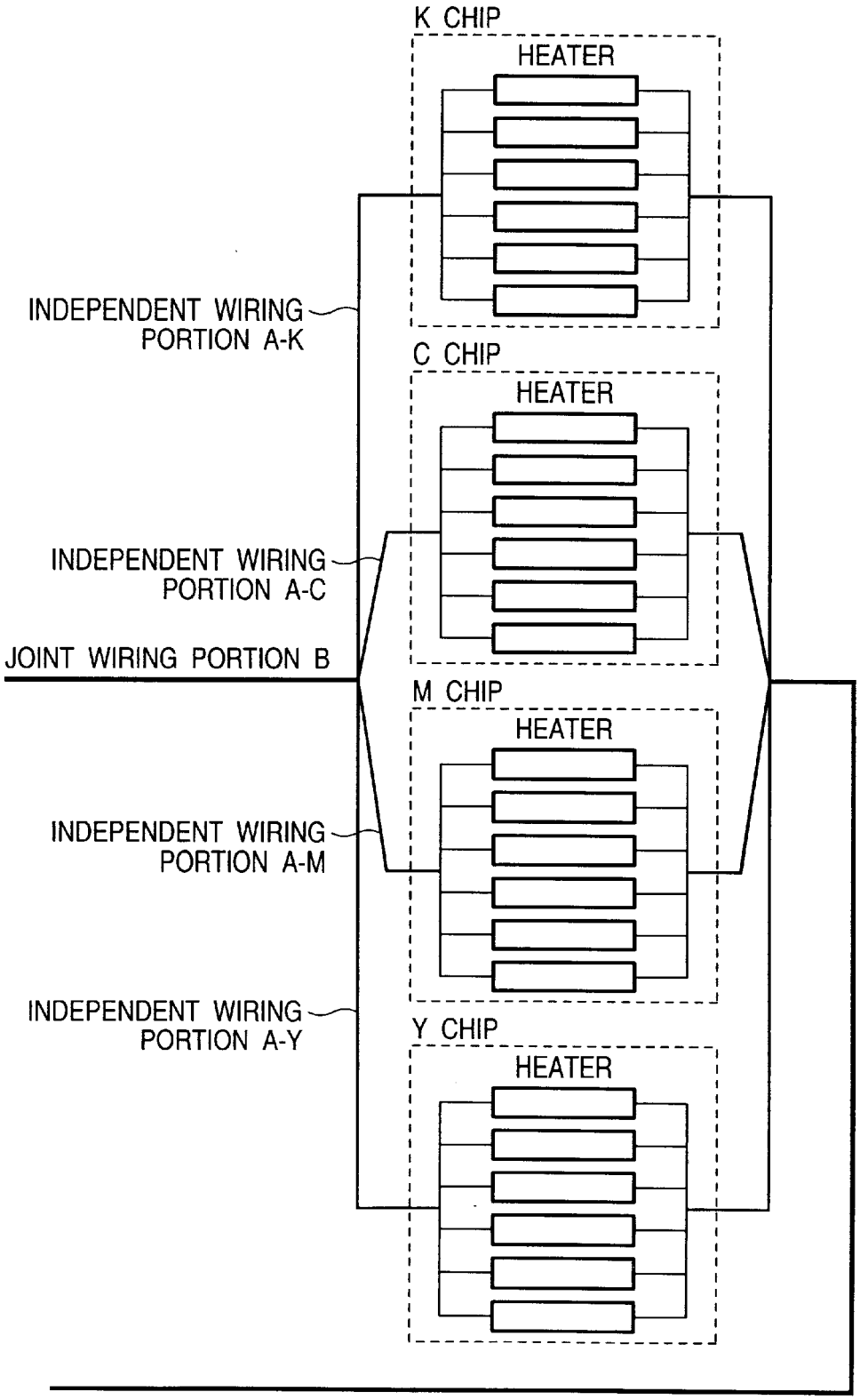
FIG. 33 is a block diagram of a recording head power supply path according to a fourth embodiment of the present invention.

FIG. 33 is a block diagram showing the electric power supply path of the recording head according to the fourth embodiment. It should be noted that the chips used for discharging the black, cyan, magenta and yellow ink are labeled the K chip, C chip, M chip and Y chip, respectively.

As shown in FIG. 33, there exists inside the recording head both independent wiring parts A-K, A-C, A-M and A-Y provided for each of the four chips and a joint wiring part B. A voltage drop occurs in each of the independent wiring portions whose amount coincides with the number of heaters (that is, recording elements) to be driven simultaneously within each of the color chips. Similarly, a voltage drop occurs in the joint wiring part B whose amount coincides with the number of recording elements driven simultaneously among all four chips. Therefore, when the number of recording elements to be driven at the same time among the four chips changes, the amount of the voltage drop up to each of the chips, that is, the amount of the voltage drop at the joint wiring part B, changes.

A description will now be given of the process of compensating for the voltage drop.

Figure 34:
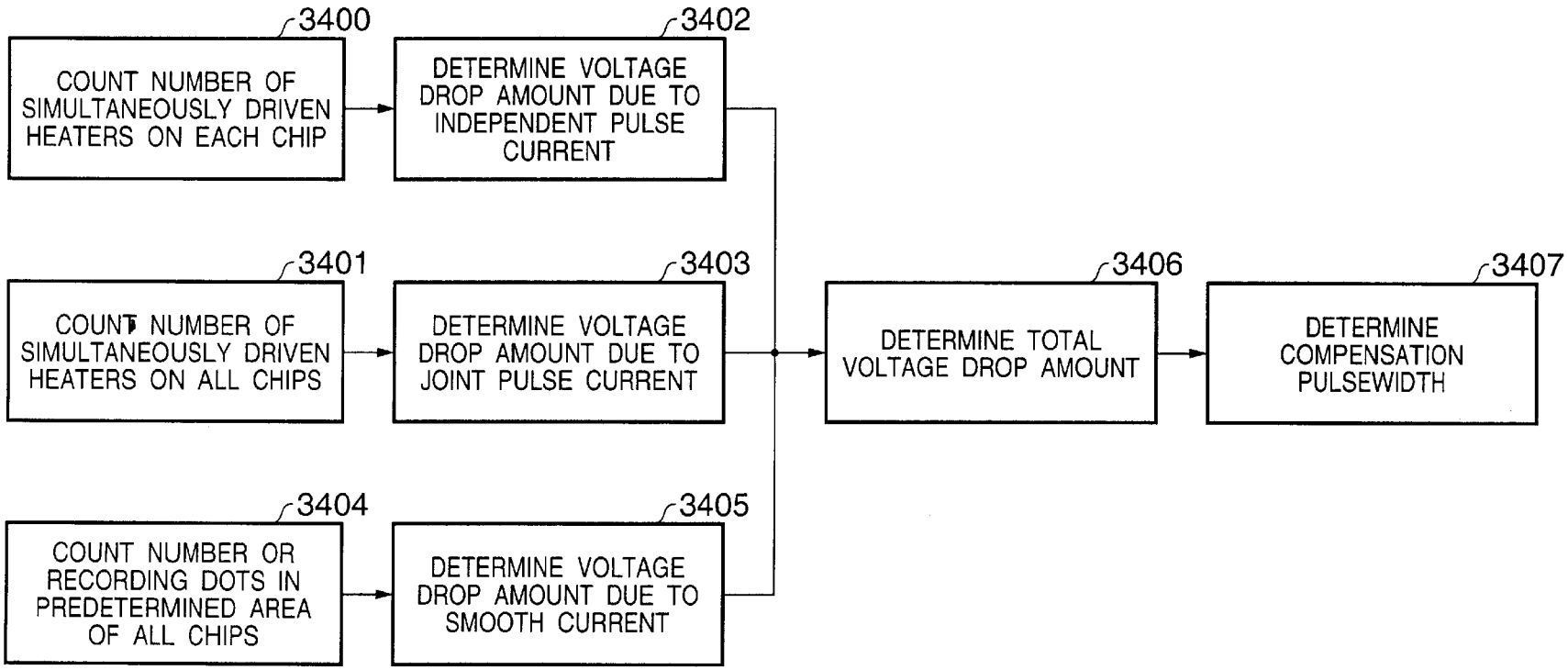
FIG. 34 is a block diagram illustrating a voltage drop compensation process using a heat pulse according to the fourth embodiment of the present invention.

FIG. 34 is a block diagram illustrating a voltage drop compensation process using a heat pulse according to the fourth embodiment of the present invention.

According to FIG. 34, at 3400 the number of recording elements to be driven simultaneously during the introduction of the block trigger signal (Trig) for the chips is counted, and the voltage drop amount over the independent pulse current portions of the chips is determined from that count value at 3402. At the same time, the number of recording elements to be driven simultaneously among all four chips is counted at 3401, and the voltage drop amount over the joint pulse current portion for all the chips is determined at 3403.

Additionally, the above-described count timing involves counting the number of dots to be recorded per predetermined number of columns of the four chips at 3404 in FIG. 34 and determining the voltage drop over the smooth current portion from the counted number of recording dots at 3405.

Then, from the amount of the drop in voltage over the independent pulse current portions and the joint pulse current portion and the smooth current portion, the total voltage drop amount in the electric power supply path system during block selection timing is determined at 3406 of FIG. 34. From the total voltage drop amount so obtained, the pulsewidth to be compensated is determined at 3407.

A detailed description will now be given of the processes of determining the voltage drop amount and controlling the compensation pulse, with reference to the drawings.

Figure 35:
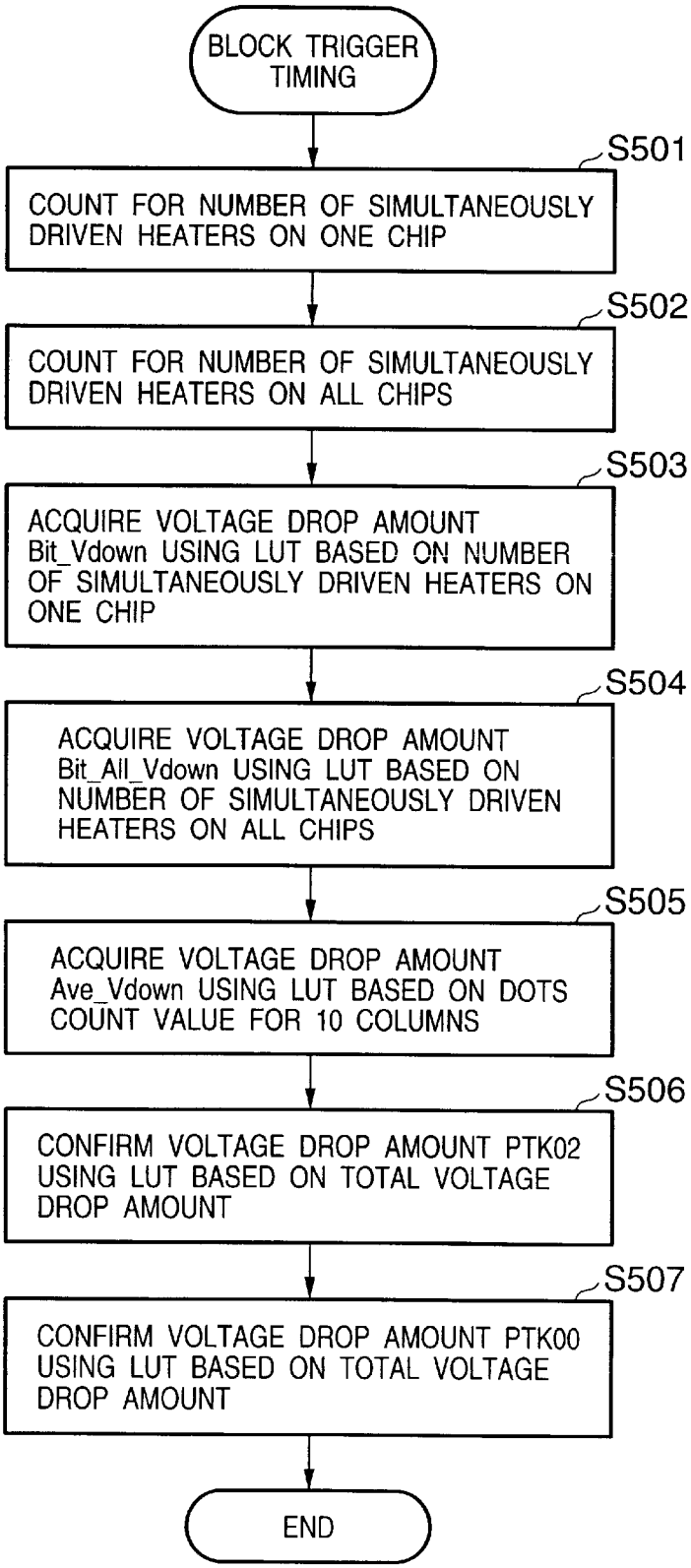
FIG. 35 is a flow chart showing a timing process in which a block trigger signal (Trig) is introduced.

FIG. 35 is a flow chart showing a timing process in which a block trigger signal (Trig) is inserted.

As shown in FIG. 35, in the interrupt routine of the timing of the introduction of the block trigger signal (Trig), first, the number of recording elements to be driven simultaneously at a single chip is counted in a step S501. Next, the number of recording elements to be driven simultaneously across all four chips is then counted in a step S502.

To continue, the voltage drop amount Bit_Vdown in the independent pulse current portion corresponding to that chip is obtained by referencing a look-up table (LUT) in a step S503 based on the number of recording elements to be driven simultaneously in one chip as counted in the step S501. Then, the voltage drop amount Bit_All_Vdown in the joint pulse current portion is obtained from a look-up table LUT in a step S504, based on the number of recording elements to be driven simultaneously across all four chips as counted in the step S502.

Next, based on the 10-column dot count as counted in the 600 dpi encoder 14 signal output timing, the amount of the voltage drop Ave_Vdown in the smooth circuit portion is obtained from a LUT in a step S505. Then, in a step S506, the timing PT02 of the introduction of the main heat pulse is set based on the total voltage drop amount obtained by adding the above-described Bit_Vdown and Bit_All_Vdown and Ave_Vdown voltage drop amounts together.

Finally, in a step S507, the compensation pulsewidth PTK00 is set based on the total voltage drop amount obtained by adding the above-described Bit_Vdown and Bit_All_Vdown and Ave_Vdown voltage drop amounts together.

The above-described process is repeated for as many times as there are chips, to set the compensation pulsewidth PTK00 and main heat pulse introduction timing PT02.

A description will now be given of the process of setting the basic pulse and the various tables, with reference to the drawings.

The main difference between the third embodiment described previously and the fourth embodiment is that, in the latter, the voltage drop amount Bit_All_Vdown of the pulse current portion from the number of recording elements driven simultaneously is obtained from a look-up table LUT. The voltage drop amounts Bit_Vdown and Ave_Vdown are obtained in the same way as they are for the third embodiment, so a description will be given here of the process of setting the table for determining the voltage drop amount Bit_All_Vdown of the joint pulse current portion corresponding to the head index when the recording head 2 is mounted in the recording apparatus.

FIG. 36 shows a sample table defining 14 ranks of voltage drop levels of a joint pulse current portion corresponding to individual head indexes.

When a head index is acquired from the recording head 2, a table of voltage drop amounts Bit_All_Vdown of the joint pulse current portion that corresponds to that index is set.

Thus, the setting table is determined according to the head index as determined by the heater resistance and other factors specific to each individual recording head. This type of table setting, based as it is on information that is specific to individual recording heads, allows voltage drop amounts to be determined accurately.

Accordingly, according to the fourth embodiment of the present invention as described above, it is possible to accurately determine the voltage drop amounts at the independent pulse current portion, at the joint pulse current portion and at the smooth current portion and to set an appropriate compensation pulsewidth for each chip even when employing a recording head configured so as to consist of a plurality of chips and comprising an independent wiring portion and a joint wiring portion.

Fifth Embodiment

A description will now be given of a fifth embodiment of the present invention, with reference to the accompanying drawings.

Figure 37:
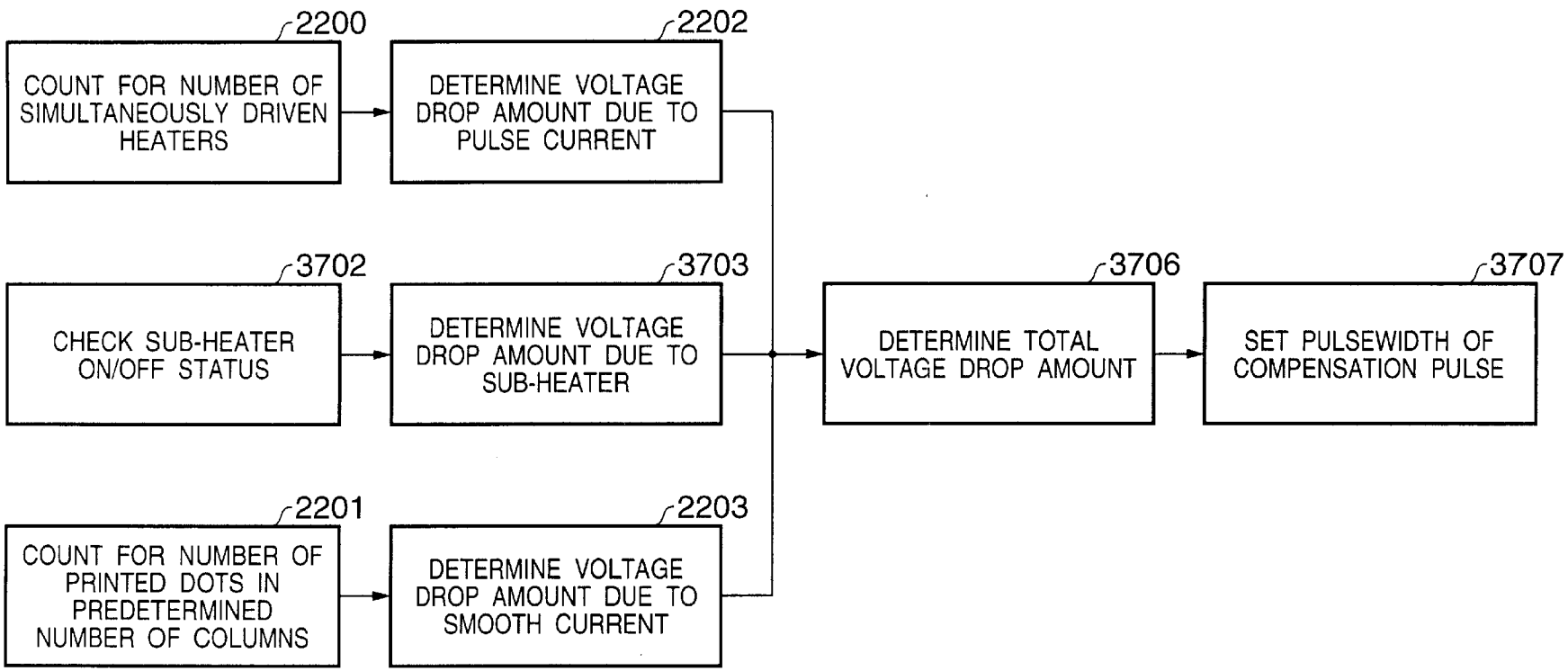
FIG. 37 is a block diagram illustrating a voltage drop compensation process for a heat pulse according to a fifth embodiment of the present invention.

FIG. 37 is a block diagram illustrating a voltage drop compensation process using a heat pulse according to a fifth embodiment of the present invention. It should be noted that, for identical elements, FIG. 37 employs the same reference numbers as those used to describe the third embodiment with reference to FIG. 22, and a detailed description thereof is omitted. Here, only the distinctive elements of the fifth embodiment are described.

According to FIG. 37, at 3702 it is ascertained whether or not electric power is being applied to the sub-heaters, and at 3703 the amount of the drop in voltage over the pulse current section due to the sub-heaters is determined. The total voltage drop amount through the entire electric power supply wiring system during block selection timing is then determined from the voltage drop amount over the pulse current portion and the smooth current portion at 3706, with the compensation pulse being determined from the total voltage drop amount at 3707.

A description will now be given of the process of determining the voltage drop amount and of controlling the compensation pulse.

In addition to the routines executed by the third embodiment previously described, the fifth embodiment of the present invention determines whether or not the sub-heaters are currently ON, determines the voltage drop amount caused by the sub-heaters, and further, determines the compensation pulsewidth PTK00 and the timing PT02 of the introduction of the main heat pulse from the voltage drop amount due to the sub-heaters and from the voltage drop amount over the pulse current portion and the smooth current portion as the ink is discharged.

A description will now be given of the process by which the basic pulses and tables are given their settings, with reference to FIG. 25.

In addition to the routines executed by the third embodiment of the present invention described previously, with the fifth embodiment of the present invention the sub-heater-generated pulse current portion voltage drop amount is set according to the head index as a process undertaken when the recording head is mounted on the recording apparatus.

Figure 38:
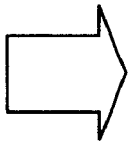
FIG. 38 shows a sample table defining sub-heater-generated pulse current portion voltage drop levels corresponding to a Pulse No.

FIG. 38 is a diagram showing a table that defines pulse current portion voltage drop levels due to a sub-heater corresponding to a pulse No.

According to FIG. 38, when a head index is acquired from the recording head, a voltage drop amount over the pulse current portion due to the sub-heaters that corresponds to that head index is selected.

Thus, the extent of the impact of the sub-heaters is set according to the head index, which is determined by the specific heater resistance and so forth of the individual recording heads. Accordingly, the voltage drop amount can be accurately determined based on information that is specific to each recording head.

According to the fifth embodiment of the present invention described above, the voltage drop amount in the pulse current portion due to the discharge heaters and the voltage drop amount in the pulse current portion due to the sub-heaters can be determined accurately, and the compensation pulsewidth can be set appropriately.

In particular, using the recording head according to the above-described fifth embodiment not only makes it possible to maintain the temperature using the sub-heaters other than the discharge heaters under low-temperature conditions, but also makes it possible to reflect the voltage drop amount caused by the use of such sub-heaters in the control of the pulsewidth.

It should be noted that, in the above-described embodiment, it is assumed that the drops of fluid discharged from the recording head or recording heads are ink, and that the fluid contained in the ink tank is also ink. However, the present invention is not limited to the use of ink. Thus, for example, in order to provide the recording image with enhanced adhesion and waterproof properties, or to improve the quality of the image, a processing fluid that is discharged onto the recording medium may be contained in the ink tank.

The above-described embodiments have the advantage of being able to determine accurately the amount of the voltage drop during recording, and from that accurate determination of voltage drop amount are able to provide appropriate control of the pulse signal that drives the recording elements. An additional advantage of such accurate determination and appropriate control is that the recording elements are always supplied with and driven by signals of the proper pulsewidth. As a result, no excess electrical current is introduced to the recording elements, and accordingly, the recording elements are not subjected to unnecessary wear and their working lives are extended. Ultimately, these arrangements make it possible to provide a recording apparatus capable of delivering stable, long-term recording performance.

The above-described embodiments, particularly when used in ink jet recording systems, are capable of achieving high-density, highly detailed recordings by using a process in which a thermal energy-generating means (such as, an electrothermal transducer) for providing the energy used to discharge the ink is used to cause changes in the state of the ink.

The present invention provides outstanding effects with a print head and recording apparatus of the ink-jet recording type, especially of the kind that utilizes thermal energy.

With regard to a typical configuration and operating principle, it is preferred that the foregoing be achieved using the basic techniques disclosed in the specifications of U.S. Pat. Nos. 4,723,129 and 4,740,796. This scheme is applicable to both so-called on-demand-type and continuous-type apparatuses. In the case of the on-demand type, at least one drive signal, which provides a sudden temperature rise that exceeds that for film boiling in accordance with the recording information, is applied to an electrothermal transducer arranged to correspond to a sheet or fluid passageway holding a fluid (ink). As a result, thermal energy is produced in the electrothermal transducer to bring about film boiling on the thermal working surface of the print head. Accordingly, air bubbles can be formed in the fluid (ink) in one-to-one correspondence with the drive signals. Owing to growth and contraction of the air bubbles, the fluid (ink) is jetted via a discharge opening so as to form at least one drop of ink. If the drive signal has the form of a pulse, growth and contraction of the air bubbles can be made to take place rapidly and in appropriate fashion, and is preferred since it will be possible to achieve fluid (ink) discharge exhibiting excellent response.

Signals described in the specifications of U.S. Pat. Nos. 4,463,359 and 4,345,262 are suitable as drive pulses having this pulse shape. It should be noted that even better recording can be performed by employing the conditions described in the specification of U.S. Pat. No. 4,313,124, which discloses an invention relating to the rate of increase in the temperature of the above-mentioned thermal working surface.

In addition to the combination of the opening, fluid passageway and electrothermal transducer (in which the fluid passageway is linear or right-angled) disclosed as the construction of the print head in each of the above-mentioned specifications, an arrangement using the art described in the specifications of U.S. Pat. Nos. 4,558,333 and 4,459,600, which disclose elements disposed in an area in which the thermal working portion is curved, may be employed. Further, it is possible to adopt an arrangement based upon Japanese Patent Application Laid-Open No. 59-123670, which discloses a configuration having a common slot for the ink discharge portions of a plurality of electrothermal transducers, or Japanese Patent Application Laid-Open No. 59-138461, which discloses a configuration having openings made to correspond to the ink discharge portions, wherein the openings absorb pressure waves of thermal energy.

As a print head of the full-line type having a length corresponding to the maximum width of the recording medium capable of being printed on by the recording apparatus, use can be made of an arrangement in which the length is satisfied by a combination of plural print heads of the kind disclosed in the foregoing specifications, or an arrangement in which recording heads serve as a single integrally formed recording head.

The print head may be of the replaceable chip-type, in which the connection to the apparatus and the supply of ink from the apparatus can be achieved by mounting the head on the apparatus, or of the cartridge type, in which the head itself is integrally provided with an ink tank.

In order to achieve the effects of the present invention more stably, it is preferred that the recording apparatus of the present invention be additionally provided with recovery means and preparatory auxiliary means for the print head. Specific examples are print head capping means, print head cleaning means, print head pressurizing or suction means, print head preheating means comprising an electrothermal transducer, or a heating element separate from this transducer or a combination of the transducer and the heating element, and a preliminary discharge mode for performing a discharge of ink separate from a discharge for recording purposes. These expedients are effective in achieving stable recording.

The recording mode of the recording apparatus is not limited to a recording mode solely for mainstream black-and-white recording. Rather, the apparatus adopted can be one equipped with at least one recording head for a plurality of different colors or one full-color print head using mixed colors, through it is desired that this be achieved by a print head having an integrated structure or by a combination of a plurality of print heads.

The recording apparatus of the present invention may take on the form of an apparatus that is an integral part of or separate from an image output terminal of information processing equipment such as a computer, a copier in combination with a reader or the like, or a facsimile machine having a transmitting/receiving function.

The present invention can be applied to a system comprising a plurality of devices (e.g., a host computer, interface, reader, printer, etc.) or to an apparatus comprising a single device (.e.g., a copier or facsimile machine, etc.).

Further, it goes without saying that the object of the present invention can also be achieved by providing a recording medium storing the program codes of the software for performing the aforesaid functions of the foregoing embodiments to a system or an apparatus, reading the program codes with a computer (e.g., a CPU or MPU) of the system or apparatus from the recording medium, and then executing the program.

In this case, the program codes read from the recording medium implement the novel functions of the invention, and the recording medium storing the program codes constitutes the invention.

Further, the recording medium, such as a floppy disk, hard disk, optical disk, magneto-optical disk, CD-ROM, CD-R, magnetic tape, non-volatile type memory card or ROM can be used to provide the program codes.

Furthermore, besides the case where the aforesaid functions according to the embodiments are implemented by executing the program codes read by a computer, the present invention covers a case where an operating system or the like working on the computer performs a part of or the entire process in accordance with the designation of program codes and implements the functions according to the embodiment.

The present invention further covers a case where, after the program codes read from the recording medium are written in a function extension board inserted into the computer or in a memory provided in a function extension unit connected to the computer, a CPU or the like contained in the function extension board or function extension unit performs a part of or the entire process in accordance with the designation of program codes and implements the function of the above embodiments.

It should be noted that the configurations and operations described above with reference to the individual embodiments, whether practiced individually and separately are whether practiced through an appropriate combination of several embodiments, are within the spirit and scope of the present invention.

The present invention is not limited to the above-described embodiments, and various changes and modifications can be made within the spirit and scope of the present invention. Therefore, to apprise the public of the scope of the present invention, the following claims are made.

What is claimed is:

1. A recording apparatus that records using a recording head having a plurality of recording elements, the recording apparatus comprising:

power supply means for supplying to the recording head a drive current for driving the plurality of recording elements;

electrical charge storage means provided on a drive current supply path between the power supply means and the recording head;

first evaluation means for estimating a voltage drop amount across a first section of the drive current supply path between said power supply means and said electrical charge storage means;

second evaluation means for estimating a voltage drop amount across a second section of the drive current supply path between said electrical charge storage means and the recording head; and control means for controlling a pulsewidth of the drive current used to drive the recording elements based on the voltage drop amount estimated by the fast evaluation means and second evaluation means.

2. The recording apparatus according to claim 1, wherein a change over time of the drive current in the first section is relatively small and a change over time of the drive current in the second section is relatively large.

3. The recording apparatus according to claim 1, wherein said first evaluation means comprises:

first counting means for counting a number of recording dots recorded by the recording head in a recording of a predetermined period; and first discriminating means for determining an amount of a drop in voltage in the first section based on the count value counted by said first counting means.

4. The recording apparatus according to claim 3, wherein the predetermined period is a time period that stores electric power required for a recording operation of the recording head using a charge stored in said electrical charge storage means.

5. The recording apparatus according to claim 3, wherein said first discriminating means determines the voltage drop amount using a Look-Up Table (LUT).

6. The recording apparatus according to claim 1, wherein the second evaluation means comprises:

second counting means for counting a number of recording elements to be driven simultaneously during a recording operation of the recording head; and second discriminating means for determining an amount of a drop in voltage in the second section based on the count value counted by said second counting means.

7. The recording apparatus according to claim 6, wherein said second discriminating means determines the voltage drop amount using a Look-Up Table (LUT).

8. The recording apparatus according to claim 1, wherein the recording head is provided with a non-volatile memory that stores property information specific to the recording head.

9. The recording apparatus according to claim 8, wherein said first evaluation means and said second evaluation means estimate the voltage drop amount by referencing respective corresponding LUTs based on the property information stored in the nonvolatile memory of the recording head.

10. The recording apparatus according to claim 1, wherein the control means comprises:

third evaluation means for estimating a voltage drop amount over the entire drive current supply path from a voltage drop amount over the first section and the second section of the drive current supply path estimated by said first evaluation means and said second evaluation means; and determining means for determining an amount by which a pulsewidth is to be adjusted, based on results from said third evaluation means.

11. The recording apparatus according to claim 1, wherein the recording head is an ink jet recording head.

12. The recording apparatus according to claim 11, wherein the ink jet recording bead is a recording head for performing color recording, the ink jet recording head comprising:

a first chip equipped with a group of recording elements for discharging yellow ink;

a second chip equipped with a group of recording elements for discharging magenta ink;

a third chip equipped with a group of recording elements for discharging cyan ink; and a fourth chip equipped with a group of recording elements for discharging black ink.

13. The recording apparatus according to claim 12, wherein the drive current supply path includes a joint section corresponding to the first through fourth chips inclusive as well as specific sections that are specific to each of the first through fourth chips, respectively; and said first evaluation means estimates a voltage drop across the joint section and each one of the specific sections, respectively.

14. The recording apparatus according to claim 11, wherein the ink jet recording head is provided with a sub-heater to maintain head temperature.

15. The recording apparatus according to claim 14, wherein the sub-heater comprises:

determination means for determining whether the sub-heater is driven or not; and fourth evaluation means for estimating a voltage drop amount due to driving of the sub-heater according to results from said determination means, wherein said control means further controls the pulsewidth of the drive current by taking into account the voltage drop amount estimated by said fourth evaluation means.

16. A recording control method, comprising:

a first evaluation step for estimating a voltage drop amount across a first section of a drive current supply path provided with an electrical charge storage unit disposed between an electric power supply unit and a recording head, wherein the first section is defined between the electrical power supply unit and the electrical charge storage unit;

a second evaluation step for estimating a voltage drop amount across a second section of the drive current supply path, between the electrical charge storage unit and the recording head; and a control step for controlling a pulsewidth of the drive current based on a voltage drop amount estimated in said first evaluation step and said second evaluation step.

17. The recording control method according to claim 16, wherein said first evaluation step comprises:

a first counting step for counting a number of recording dots recorded by the recording head upon recording of a predetermined period; and a first discriminating step for determining an amount of a drop in voltage in the first section based on the count value counted at said first counting step.

18. The recording control method according to claim 17, wherein the predetermined period is a period that stores electric power required for a recording operation of the recording head using the electrical charge charged in the electrical charge storage unit.

19. The recording control method according to claim 16, wherein said second evaluation step comprises:

a second counting step for counting a number of recording elements to be driven simultaneously during a recording operation of the recording head; and a second discriminating step for determining an amount of a drop in voltage in the second section based on the count value counted at said second counting step.

20. The recording control method according to claim 16, wherein said control step comprises:

a third evaluation step for estimating a voltage drop amount over the entire drive current supply path from a voltage drop amount over the first section and the second section of the drive current supply path estimated at said first evaluation step and said second evaluation step, respectively; and a determination step of determining an amount by which a pulsewidth is to be adjusted, based on results estimated at said third evaluation step.

21. The recording control method according to claim 16, wherein the recording head is a color ink jet recording head, the recording head comprising:

a first chip equipped with a group of recording elements for discharging yellow ink;

a second chip equipped with a group of recording elements for discharging magenta ink;

a third chip equipped with a group of recording elements for discharging cyan ink; and a fourth chip equipped with a group of recording elements for discharging black ink, wherein the drive current supply path includes a joint section corresponding to the first through fourth chips inclusive as well as specific sections that are specific to each of the first through fourth chips, respectively, and in said first evaluation step, a voltage drop across the joint section and each one of the specific sections is estimated, respectively.

22. The recording method according to claim 16, wherein the recording head is an ink jet recording head equipped with a sub heater for maintaining the head temperature, the recording method further comprising:

a determination step for determining whether the sub heater has been driven; and a fourth evaluation means for estimating a voltage drop amount due to driving of the sub-heater, according to results determined at said determination step, wherein in said control step, the pulsewidth of the drive current is further controlled by taking into account the voltage drop amount estimated at said fourth evaluation step.

* * * * *

UNITED STATES PATENT AND TRADEMARK OFFICE

CERTIFICATE OF CORRECTION

PATENT NO. : 6,652,058 B2
DATED : November 25, 2003
INVENTOR(S) : Kanematsu et al.

It is certified that error appears in the above-identified patent and that said Letters Patent is hereby corrected as shown below:

Column1,
Line 29, “head” should read -- head crosses the space between the recording head --.

Column 2,
Line 53, “this” should read -- This --.

Column 6,
Line 51, “not” should read -- (not --, and “drawing” should read -- drawing) --; and
Line 52, “head” should read -- recording --.

Column 8,
Line 40, “ROM” should read -- a ROM --.

Column 10,
Line 3, “form” should read -- from --.

Column 11,
Line 46, “color” should read -- a color --.

Column 13,
Line 1, “the into” should read -- into the --.

Column 18,
Line 8, “to” (first occurrence) should read -- of --.

Column 19,
Line 9, “a a” should read -- a --.

Column 20,
Line 37, “though” should read -- thought --; and
Line 44, “by” should read -- by, -- and “example” should read -- example, --.

Column 22,
Line 52, “ion” should read -- in --.

Column 23,
Line 32, “contain” should read -- contains --.

UNITED STATES PATENT AND TRADEMARK OFFICE

CERTIFICATE OF CORRECTION

PATENT NO. : 6,652,058 B2
DATED : November 25, 2003
INVENTOR(S) : Kanematsu et al.

It is certified that error appears in the above-identified patent and that said Letters Patent is hereby corrected as shown below:

Column 24,
Line 2, “Pt00” should read -- PT00 --;
Line 8, “st” should read -- set --; and
Line 66, “drop” should read -- drop amount --.

Column 28,
Line 51, “as,” should read -- as --.

Column 30,
Line 3, “through” should read -- though --; and
Line 52, “are” should read -- or --.

Column 31,
Line 14, “fast” should read -- first --.

Column 32,
Line 4, “bead” should read -- head --.

Signed and Sealed this

Seventeenth Day of August, 2004

JON W. DUDAS
*Acting Director of the United States Patent and Trademark Office*